US011486385B2

(12) United States Patent
Beisel et al.

(10) Patent No.: US 11,486,385 B2
(45) Date of Patent: Nov. 1, 2022

(54) PRESSURE PUMP BALANCING SYSTEM

(71) Applicant: Halliburton Energy Services, Inc., Houston, TX (US)

(72) Inventors: Joseph A. Beisel, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 296 days.

(21) Appl. No.: 16/322,024

(22) PCT Filed: Sep. 15, 2016

(86) PCT No.: PCT/US2016/051921

§ 371 (c)(1),
(2) Date: Jan. 30, 2019

(87) PCT Pub. No.: WO2018/052425

PCT Pub. Date: Mar. 22, 2018

(65) Prior Publication Data

US 2020/0182236 A1 Jun. 11, 2020

(51) Int. Cl.
*F04B 49/06* (2006.01)
*F04B 49/22* (2006.01)
(Continued)

(52) U.S. Cl.
CPC ..... *F04B 49/065* (2013.01); *E21B 43/26* (2013.01); *F04B 49/22* (2013.01); *F04B 51/00* (2013.01)

(58) Field of Classification Search
CPC ..... E21B 43/26; F04B 49/065
See application file for complete search history.

(56) References Cited

U.S. PATENT DOCUMENTS 3,921,435 A 11/1975 Howard
4,333,424 A 6/1982 McFee
(Continued)

FOREIGN PATENT DOCUMENTS

WO 2011095935 8/2011
WO 2015023283 2/2015
(Continued)

OTHER PUBLICATIONS

International Patent Application No. PCT/US2016/051921 , "International Search Report and Written Opinion", dated Jun. 5, 2017, 16 pages.

(Continued)

*Primary Examiner* — Eman A Alkafawi
(74) *Attorney, Agent, or Firm* — Kilpatrick Townsend & Stockton LLP

(57) ABSTRACT

A system may include multiple strain gauges and multiple position sensors positioned on multiple pressure pumps. The strain gauges may measure strain in chambers of the pressure pumps. The position sensors may measure positions of rotating members of the pressure pumps. One or more computing devices may be communicatively couplable to the strain gauges and the position sensors to determine an adjustment to a flow rate of fluid through at least one pump using a strain measurement and a position measurement for the at least one pump such that a timing of changes in composition of the fluid delivered to into a first manifold at an input for the pressure pumps matches the timing of the changes in composition of the fluid delivered from a second manifold at an output for the pressure pumps.

20 Claims, 12 Drawing Sheets

(51) Int. Cl.
*F04B 51/00* (2006.01)
*E21B 43/26* (2006.01)

(56) References Cited

U.S. PATENT DOCUMENTS

| | | | | |
|---|---|---|---|---|
| 4,705,459 | A | 11/1987 | Buisine et al. | |
| RE33,649 | E | 7/1991 | Kawai | |
| 5,180,287 | A | 1/1993 | Natwick et al. | |
| 5,846,056 | A | 12/1998 | Dhindsa et al. | |
| 6,155,347 | A | 12/2000 | Mills | |
| 6,859,740 | B2 | 2/2005 | Stephenson et al. | |
| 6,882,960 | B2 | 4/2005 | Miller | |
| 7,043,975 | B2 | 5/2006 | Du | |
| 7,623,986 | B2 | 11/2009 | Miller | |
| 8,807,960 | B2 | 8/2014 | Stephenson et al. | |
| 8,905,056 | B2 * | 12/2014 | Kendrick | F04D 29/426 137/15.01 |
| 9,759,213 | B2 | 9/2017 | Bassett et al. | |
| 10,480,296 | B2 | 11/2019 | Beisel | |
| 10,564,020 | B2 | 2/2020 | Beisel | |
| 10,914,302 | B2 | 2/2021 | Beisel | |
| 2002/0007952 | A1 | 1/2002 | Vann | |
| 2002/0176784 | A1 | 11/2002 | Du | |
| 2004/0018100 | A1 | 1/2004 | Takagi et al. | |
| 2004/0144529 | A1 | 7/2004 | Barnes et al. | |
| 2004/0158419 | A1 | 8/2004 | Pearson et al. | |
| 2005/0025631 | A1 | 2/2005 | Lake et al. | |
| 2005/0180868 | A1 | 8/2005 | Miller | |
| 2006/0037408 | A1 | 2/2006 | Peter | |
| 2007/0041849 | A1 | 2/2007 | Allen | |
| 2007/0139211 | A1 | 6/2007 | Pessin et al. | |
| 2007/0140869 | A1 | 6/2007 | St. Michel et al. | |
| 2008/0260558 | A1 | 10/2008 | Luongo et al. | |
| 2009/0041588 | A1 | 2/2009 | Hunter et al. | |
| 2009/0129935 | A1 | 5/2009 | Kunkler et al. | |
| 2009/0180866 | A1 | 7/2009 | Bourgeois et al. | |
| 2009/0317262 | A1 | 12/2009 | Gilpatrick | |
| 2010/0252262 | A1 | 10/2010 | Ekstrand et al. | |
| 2010/0300683 | A1 | 12/2010 | Looper et al. | |
| 2010/0310384 | A1 | 12/2010 | Stephenson et al. | |
| 2011/0011581 | A1 | 1/2011 | Stephenson et al. | |
| 2011/0046903 | A1 | 2/2011 | Franklin | |
| 2012/0144995 | A1 | 6/2012 | Bayyouk et al. | |
| 2013/0151216 | A1 | 6/2013 | Palka et al. | |
| 2013/0213647 | A1 * | 8/2013 | Roddy | E21B 47/13 166/255.1 |
| 2013/0261993 | A1 | 10/2013 | Ruchti et al. | |
| 2014/0096957 | A1 | 4/2014 | Van Zuilekom et al. | |
| 2014/0166267 | A1 | 6/2014 | Weightman et al. | |
| 2014/0288858 | A1 | 9/2014 | Franklin | |
| 2015/0027693 | A1 | 1/2015 | Edwards et al. | |
| 2015/0083400 | A1 * | 3/2015 | Stephenson | E21B 43/267 166/250.01 |
| 2015/0226058 | A1 * | 8/2015 | Stolpman | E21B 47/18 702/9 |
| 2015/0377318 | A1 | 12/2015 | Byrne | |
| 2016/0305419 | A1 | 10/2016 | Liu et al. | |
| 2016/0339535 | A1 | 11/2016 | Hess et al. | |
| 2017/0138645 | A1 | 5/2017 | Sakima et al. | |
| 2018/0223644 | A1 | 8/2018 | Beisel | |

FOREIGN PATENT DOCUMENTS

| | | |
|---|---|---|
| WO | 2017039692 | 3/2017 |
| WO | 2017039695 | 3/2017 |
| WO | 2017039698 | 3/2017 |
| WO | 2017039700 | 3/2017 |
| WO | 2017039701 | 3/2017 |
| WO | 2018044293 | 3/2018 |

OTHER PUBLICATIONS

Application No. PCT/US2016/049682 , International Search Report and Written Opinion, dated May 23, 2017, 17 pages.
Application No. SA519400894 , Office Action, dated Jun. 30, 2021, 4 pages.

* cited by examiner

PRESSURE PUMP BALANCING SYSTEM

TECHNICAL FIELD

The present disclosure relates generally to pressure pumps for a wellbore and, more particularly (although not necessarily exclusively), to balancing fluid delivery from multiple pressure pumps to perform fracturing operations in a wellbore environment.

BACKGROUND

Pressure pumps may be used in wellbore treatments. For example, hydraulic fracturing (also known as "fracking" or "hydro-fracking") may utilize multiple pressure pumps to introduce or inject fluid at high pressures into a wellbore to create cracks or fractures in downhole rock formations near a target production zone. In some fracturing operations, a well operator may attempt to "pillar frack" the formation, which involves cyclically introducing pulses or plugs of proppant into clean fluid to provide the target production zone with a step-changed fracturing fluid. The step-changed fracturing fluid may create strategically placed proppant pillars within the fractured formation to enhance conductivity.

DETAILED DESCRIPTION

Figure 1:
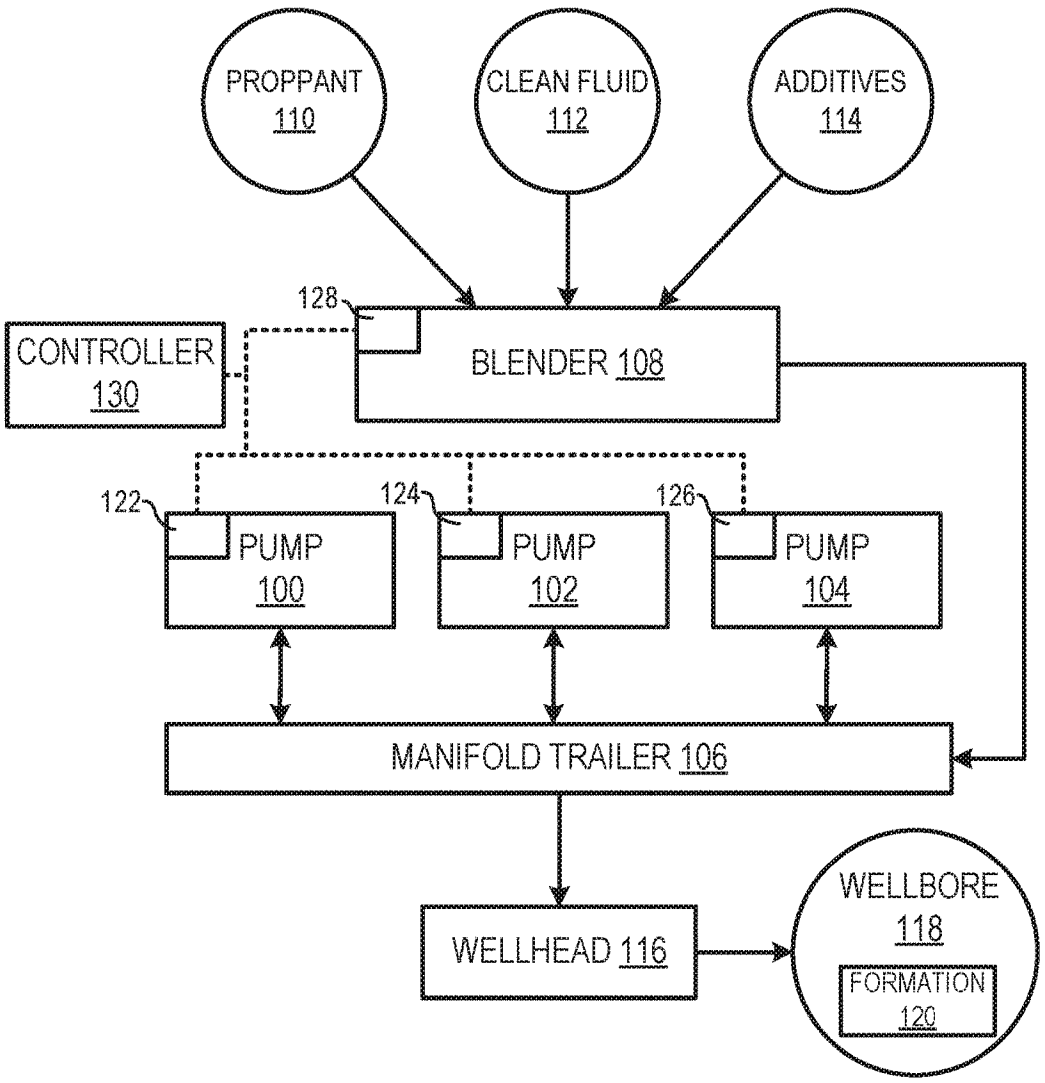
FIG. 1 is a block diagram depicting an example of a multiple-pump wellbore environment according to one aspect of the present disclosure.

Certain aspects and examples of the present disclosure relate to adjusting individual flow rates of fracturing fluid through multiple pressure pumps to cause changes in fluid composition to occur simultaneously at a common fluid-delivery location. A computing device may receive a total flow rate corresponding to the delivery of fluid to a fluid manifold coupled to the pressure pumps along a common flow path. Using the total flow rate, the computing device may determine the necessary flow rate for each pressure pump, individually, to achieve a balanced pumping system where a timing pattern of the changes in the fluid composition out of the fluid manifold matches the timing pattern of the fluid composition changes into the manifold. The computing device may also determine the actual flow rates of each pressure pumps in real-time by monitoring pump plunger strokes and valve actuation in the pressure pump chambers. The flow rate of each pressure pump may be individually adjusted to achieve the balanced pumping system. Balancing fluid delivery from the multiple pumps may allow fluid concentration to be quickly changed to deliver step-change pulses, or intervals, of proppant-laden for pillar fracturing in the wellbore at the desired timing.

In some aspects, each of the pressure pumps may be fluidly connected to a single manifold trailer having an output manifold for injecting the fluid into a wellbore to fracture downhole subterranean formations adjacent to the wellbore. The pressure pumps may be arranged in parallel along a common flow path of the manifold trailer at varying distances from the inlet and outlet of the manifold trailer. The arrangement of the pressure pumps may cause the transit time of fluid to the output manifold from each pressure pump to differ depending on the distance of the respective pressure pump from the output manifold and the volumetric differences of the paths between the respective pressure pumps. In one example, the computing devices may monitor an actual flow rate corresponding to a rate at which fluid enters or exits the chamber of each pressure pump. A computing device corresponding to a pump may adjust the actual flow rate to an adjusted flow rate that maintains the timing of the fluid delivery through the pumps to a wellhead for injecting downhole in a wellbore. The timing of the delivery may allow step-changes in the proppant concentration of fluid flowing through the pressure pumps to remain intact at the manifold trailer output. Injecting the fluid with the same step-changes in proppant concentration may create pillars in the fractures of formations adjacent to the wellbore.

These illustrative examples are provided to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative examples, should not be used to limit the present disclosure. The various figures described below depict examples of implementations for the present disclosure, but should not be used to limit the present disclosure.

Various aspects of the present disclosure may be implemented in various environments. For example, FIG. 1 is a cross-sectional schematic diagram depicting an example of a multiple-pump wellbore environment according to one aspect of the present disclosure. The wellbore environment includes pressure pumps 100, 102, 104. Although three pumps 100, 102, 104 are shown in the wellbore environment of FIG. 1, two pressure pumps or more than three pressure pumps may be included without departing from the scope of the present disclosure. The pumps 100, 102, 104 may be of a same type, or one or more of the pressure pumps may be of a different type. In some aspects, one or more of the pumps 100, 102, 104 may include any type of positive displacement pressure pump. The pumps 100, 102, 104 are each fluidly connected to a manifold trailer 106. In some aspects, the pumps 100, 102, 104 may include one or more flow lines, or sets of fluid pipes, to allow fluid to flow from the manifold trailer 106 into the pumps 100, 102, 104 and to flow fluid out of the pumps 100, 102, 104 and into the manifold trailer 106. In some aspects, the manifold trailer 106 may include a truck or trailer including one or more pump manifolds for receiving, organizing, or distributing wellbore servicing fluids during wellbore operations (e.g., fracturing operations). In some aspects, fluid from a first pump manifold of the manifold trailer 106 may enter the pumps 100, 102, 104 at a low pressure. The fluid may be pressurized in the pumps 100, 102, 104 and may be discharged from the pumps 100, 102, 104 into a second pump manifold of the manifold trailer 106 at a high pressure.

The fluid in the first pump manifold of the manifold trailer 106 may include fluid having various concentrations of chemicals to perform specific operations in the wellbore environment. The manifold trailer 106 is fluidly coupled to a blender 108 to receive the fluid. The blender 108 may mix solid and fluid components to generate a wellbore servicing fluid (e.g., fracturing fluid) for use in a wellbore operation. For example, the blender 108 may mix one or more of proppant 110, clean fluid 112, and additives 114 that are fed into the blender 108 via feed lines. In some aspects, the clean fluid 112 may include potable water, non-potable water, untreated water, treated water, hydrocarbon-based fluids, or other fluids suitable for a wellbore operation. The blender 108 may mix one or more the proppant 110, the clean fluid 112, and the additives 114 using known mixing methods. In other aspects, the proppant 110, the clean fluid 112, and the additives 114 may be premixed or stored in a storage tank before entering the manifold trailer 106.

The fluid in the second pump manifold of the manifold trailer 106 may be discharged to a wellhead 116 via a feed line extending from an outlet of the manifold trailer 106 to the wellhead 116. The wellhead 116 may be positioned proximate to a surface of a wellbore 118. In some aspects, the fluid discharged to the wellhead 116 may include a pumping profile corresponding to a characteristic of an operation to be performed in the wellbore environment. For example, the fluid discharged from the manifold trailer 106 may be pressurized by the pumps 100, 102, 104 and injected to generate fractures in subterranean formations 120 downhole and adjacent to the wellbore 118. The fluid may include varying concentrations of the proppant 110 and the additives 114 to increase a production of formation fluids from the formations 120 through the fractures.

A balancing system may be included in the wellbore environment to control the operations of the blender 108 and the pumps 100, 102, 104. The balancing system includes subsystems 122, 124, 126 for each of the pumps 100, 102, 104, respectively, and subsystem 128 for the blender 108. The subsystems 122, 124, 126 may monitor operational characteristics of the pumps 100, 102, 104. In some aspects, each of the subsystems 122, 124, 126 may include sensors to monitor, record, and communicate the operational characteristics of the pump. In additional and alternative aspects, the subsystems 122, 124, 126 may include a processing device or other processing means to perform adjustments to the pump. For example, the pumps 100, 102, 104 may adjust a flow rate of fluid through a pump 100, 102, 104 by modifying the speed at the crankshaft 208 causes the plunger 214 to displace fluid in the chamber 206. The subsystem 128 for the blender 108 may also include similar components to the subsystems 122, 124, 126 to monitor various operational characteristics of the blender 108 in a substantially similar manner to that of the subsystems 122, 124, 126. In some aspects, the subsystems 122, 124, 126, 128 may transmit information corresponding to the pumps 100, 102, 104 and the blender 108 to a controller 130. In some aspects, the controller 130 may include a processing device or other processing means for receiving and processing information from the pumps 100, 102, 104 and the blender 108, collectively. The controller 130 may transmit control signals to the pumps 100, 102, 104 and the blender 108 to maintain a desired operation of a wellbore operation. For example, the controller 130 may determine that a flow rate of the pump 100 must be adjusted to compensate for inefficiencies within a pump (e.g., where the actual rate and the rate necessary to maintain balance of the pumping system differ). The controller 130 may transmit a signal to cause the subsystem 122 to adjust the actual flow rate to the adjusted flow rate to maintain the timed flow rate through the manifold trailer 106. Although separate subsystems 122, 124, 126, 128 are described, the pump 100, 102, 104 and the blender 108 may be directly connected to a single controller device without departing from the scope of the present disclosure.

Figure 2:
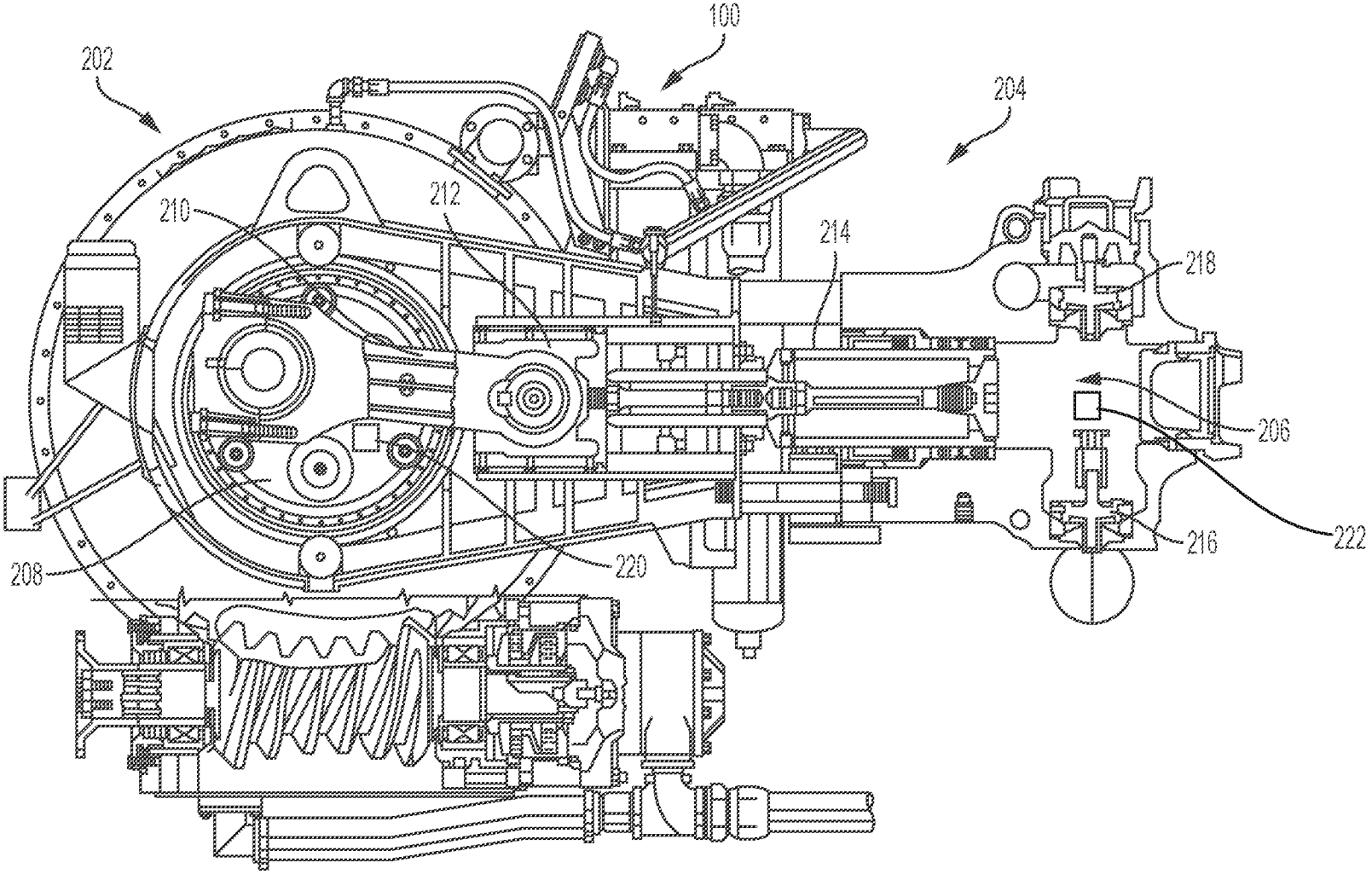
FIG. 2 is a cross-sectional schematic diagram depicting an example of a pressure pump of the wellbore environment of FIG. 1 according to one aspect of the present disclosure.

FIG. 2 is a cross-sectional schematic diagram depicting an example of the pump 100 of the wellbore environment of FIG. 1 according to one aspect of the present disclosure. Although pump 100 is described in FIG. 2, pump 100 may represent any of the pumps 100, 102, 104 of FIG. 1. The pump 100 includes a power end 202 and a fluid end 204. The power end 202 may be coupled to a motor, engine, or other prime mover for operation. The fluid end 204 includes at least one chamber 206 for receiving and discharging fluid flowing through the pump 100. Although FIG. 2 shows one chamber 206 in the pump 100, the pump 100 may include any number of chambers 206 without departing from the scope of the present disclosure.

The pump 100 also includes a rotating assembly in the power end 202. The rotating assembly includes a crankshaft 208, a connecting rod 210, a crosshead 212, a plunger 214, and related elements (e.g., pony rods, clamps, etc.). The crankshaft 208 may be mechanically connected to the plunger 214 in the chamber 206 via the connecting rod 210 and the crosshead 212. The crankshaft 208 may cause the plunger 214 for the chamber 206 to displace any fluid in the chamber 206 in response to the plunger moving within the chamber 206. In some aspects, a pump 100 having multiple chambers may include a separate plunger for each chamber. Each plunger may be connected to the crankshaft 208 via a respective connecting rod and crosshead. The chamber 206 includes a suction valve 216 and a discharge valve 218 for absorbing fluid into the chamber 206 and discharging fluid from the chamber 206, respectively. The fluid may be absorbed into and discharged from the chamber 206 in response to the plunger 214 moving. Based on the mechanical coupling of the crankshaft 208 to the plunger 214, the movement of the plunger 214 may be directly related to the movement of the crankshaft 208.

In some aspects, the suction valve 216 and the discharge valve 218 may be passive valves. As the plunger 214 operates in the chamber 206, the plunger 214 may impart motion and pressure to the fluid by direct displacement. The suction valve 216 and the discharge valve 218 may open and close based on the displacement of the fluid in the chamber 206 by the plunger 214. For example, the suction valve 216 may be opened during when the plunger 214 recesses to absorb fluid from outside of the chamber 206 into the chamber 206. As the plunger 214 is withdrawn from the chamber 206, it may create a partial suction to open the suction valve 216 and allow fluid to enter the chamber 206. In some aspects, the fluid may be absorbed into the chamber 206 from an intake manifold. Fluid already in the chamber 206 may move to fill the space where the plunger 214 was located in the chamber 206. The discharge valve 218 may be closed during this process.

The discharge valve 218 may be opened as the plunger 214 moves forward or reenters the chamber 206. As the plunger 214 moves further into the chamber 206, the fluid may be pressurized. The suction valve 216 may be closed during this time to allow the pressure on the fluid to force the discharge valve 218 to open and discharge fluid from the chamber 206. In some aspects, the discharge valve 218 may discharge the fluid into an output manifold. The loss of pressure inside the chamber 206 may allow the discharge valve 218 to close and the load cycle may restart. Together, the suction valve 216 and the discharge valve 218 may operate to provide the fluid flow in a desired direction. The process may include a measurable amount of pressure and stress in the chamber 206, such as the stress resulting in strain to the chamber 206 or fluid end 204.

In some aspects, the pump 100 may include one or more sensors positioned on the pump 100 to obtain measurements. For example, the pump 100 includes a position sensor 220 and a strain gauge 222 positioned on the pump 100. The position sensor 220 is positioned on the power end 202 to sense the position of the crankshaft 208 or another rotating component. In some aspects, the position sensor 220 is positioned on an external surface of the power end 202 (e.g., on a surface of a crankcase for the crankshaft 208) to determine a position of the crankshaft 208. The strain gauge 222 is positioned on the fluid end 204 of the pressure pump to measure the strain in the chamber 206. In some aspects, the strain gauge 222 may be positioned on an external surface of the fluid end 204 (e.g., on an outer surface of the chamber 206) to measure strain in the chambers 206.

Figure 3:
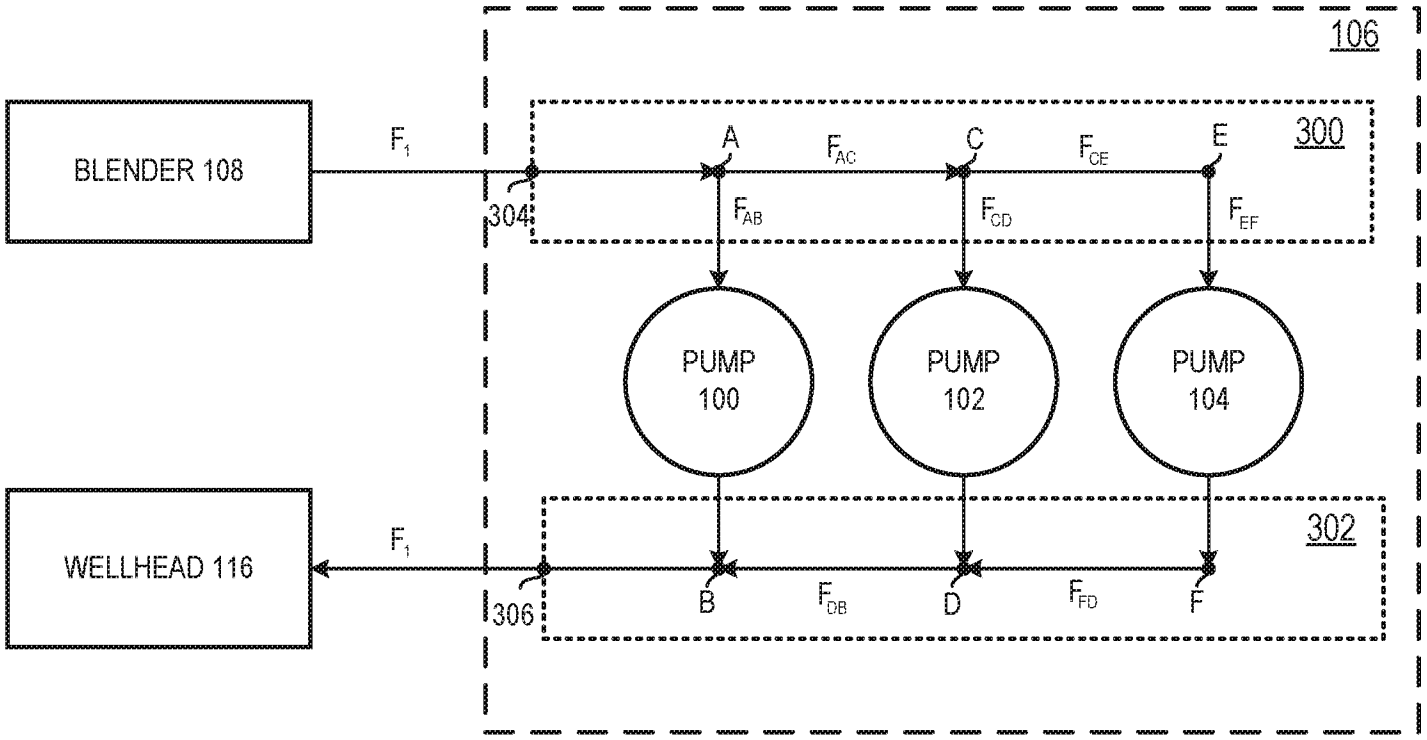
FIG. 3 is a block diagram depicting a manifold trailer of the wellbore environment of FIG. 1 according to one aspect of the present disclosure.

FIG. 3 is a block diagram depicting an example of the manifold trailer 106 of the wellbore environment of FIG. 1 positioned between the blender 108 and the wellhead 116 according to one aspect of the present disclosure. The pumps 100, 102, 104 are fluidly connected between an intake manifold 300 and an output manifold 302 of the manifold trailer 106. The intake manifold 300 may include an inlet 304 connected to a common flow line fluidly connecting the pumps 100, 102, 104 in parallel to the blender 108. The output manifold 302 may include an outlet 306 connected to a common flow line fluidly connecting the pumps 100, 102, 104 in parallel to the wellhead 116. The intake manifold 300 and the output manifold 302 include junctions A-F that allow fluid to flow from the blender 108 to the pumps 100, 102, 104 and from the pumps 100, 102, 104 to the wellhead 116. The junctions A, C, E correspond to the point where the flow of fluid from the blender 108 through a common flow line splits into two flows through separate pipes. The junctions B, D, F correspond to the point where the flow of fluid from the pumps 100, 102, 104 combines into a single flow through a common flow line to the wellhead 116.

The flow rate in each pipe segment is denoted by the variable $F_{XY}$, where the subscript "X" represents the source junction and the subscript "Y" represents the destination junction. For example, the variable $F_{AB}$ corresponds to a flow rate from the junction A to the junction B. The variable $F_{AC}$ corresponds to a flow rate from the junction A to the junction C. During a fracturing operation in the wellbore environment, the flow rate into the manifold trailer 106 and the flow rate out of the manifold trailer 106 can be the same, as denoted by the variable $F_1$. The flow rates $F_{AB}$, $F_{CD}$, $F_{EF}$ corresponding to the flow of fluid through the pumps 100, 102, 104, respectively, denote that the respective flow rate into the pumps 100, 102, 104 is the same as the flow rate coming out of the pump. This characterization of the flow rate through the pumps 100, 102, 104 presumes that each of the pumps 100, 102, 104 is operating at 100% efficiency, or in ideal conditions. During operation of the pumps 100, 102, 104, the fluid entering the inlet 304 and delivered from the blender 108 may have a step change in the proppant concentration. As the flow $F_1$ is split to pass through the pumps 100, 102, 104 and then rejoined, the integrity of the step-change in the flow from the outlet 306 may be dependent on the transit times of the fluid through each separate path through the manifold trailer 106. If the transit time through all paths is identical, then the step-change at the inlet 304, and from the blender 108, will be transferred essentially intact to the outlet 306 and to the wellhead 116.

Figure 4:
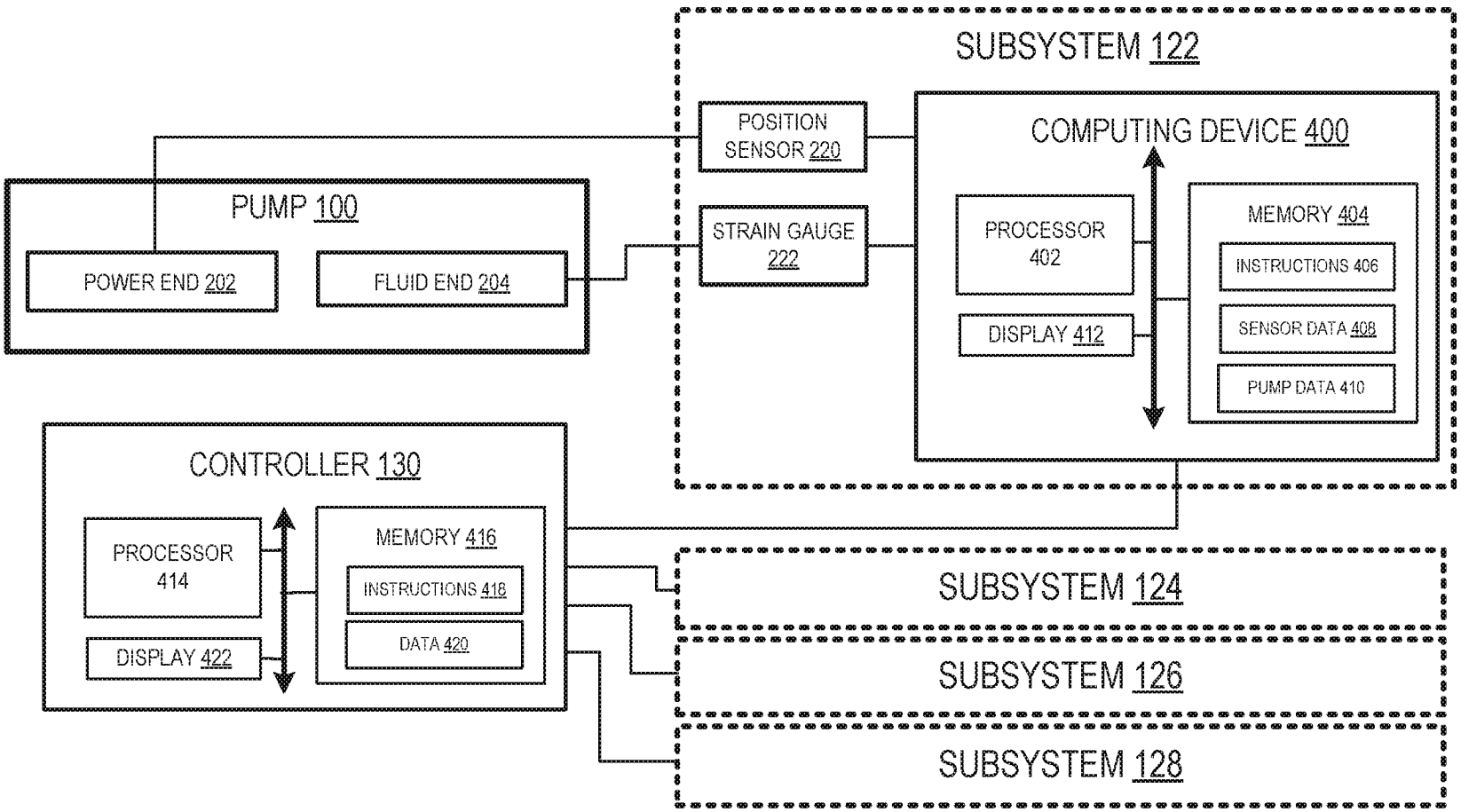
FIG. 4 is a block diagram depicting the balancing system of FIG. 1 according to one aspect of the present disclosure.

FIG. 4 is a block diagram depicting the balancing system of FIG. 1 according to one aspect of the present disclosure. In some aspects, the balancing system of FIG. 4 may include a computing device 400 with one or more components that may be included in each of the subsystems 122, 124, 126, 128 of FIG. 1. The subsystem 122 for the pump 100 includes the position sensor 220 and the strain gauge 222 communicatively coupled to the pump 100. The subsystems 124, 126 may also include respective position sensors and strain gauges for the pumps 102, 104, respectively. In some aspects, the subsystem 128 may also include one or more sensors useable to monitor conditions (e.g., concentrations of proppant) of the blender 108.

The position sensor 220 may include a magnetic pickup sensor capable of detecting ferrous metals in close proximity. In some aspects, the position sensor 220 may be positioned on the power end 202 of the pressure pump to determine the position of the crankshaft 208. In some aspects, the position sensor 220 may be placed proximate to a path of the crosshead 212. The path of the crosshead 212 may be directly related to a rotation of the crankshaft 208. The position sensor 220 may sense the position of the crankshaft 208 based on the movement of the crosshead 212. In other aspects, the position sensor 220 may be placed directly on a crankcase of the power end 202 as illustrated by position sensor 220 in FIG. 2. The position sensor 220 may determine a position of the crankshaft 208 by detecting a bolt pattern of the crankshaft 208 as the crankshaft 208 rotates during operation of the pump 100. The position sensor 220 may generate a signal representing the position of the crankshaft 208 and transmit the signal to the computing device 400.

The strain gauge 222 may be positioned on the fluid end 204. Non-limiting examples of types of strain gauges include electrical resistance strain gauges, semiconductor strain gauges, fiber optic strain gauges, micro-scale strain gauges, capacitive strain gauges, vibrating wire strain gauges, etc. In some aspects, a strain gauge 222 may be included for each chamber 206 to determine strain in each of the chambers 206, respectively. In some aspects, the strain gauge 222 may be positioned on an external surface of the fluid end 204 in a position subject to strain in response to stress in the chamber 206. For example, the strain gauge 222 may be positioned on a section of the fluid end 204 in a manner such that when the chamber 206 loads up, strain may be present at the location of the strain gauge 222. This location may be determined based on engineering estimations, finite element analysis, or by some other analysis. The analysis may determine that strain in the chamber 206 may be directly over a plunger bore of the chamber 206 during load up. The strain gauge 222 may be placed on an external surface of the pump 100 in a location directly over the plunger bore corresponding to the chamber 206 as illustrated by strain gauge 222 in FIG. 2 to measure strain in the chamber 206. The strain gauge 222 may generate a signal representing strain in the chamber 206 and transmit the signal to the computing device 400.

The computing device 400 may be coupled to the position sensor 220 and the strain gauge 222 to receive the respective signals from each. The computing device 400 includes a processor 402, a memory 404, and a display unit 412. In some aspects, the processor 402, the memory 404, and the display unit 412 may be communicatively coupled by a bus. The processor 402 may execute instructions 406 for monitoring the pump 100, determining conditions in the pump 100, and controlling certain operations of the pump 100. The instructions 406 may be stored in the memory 404 coupled to the processor 402 by the bus to allow the processor 402 to perform the operations.

The processor 402 may include one processing device or multiple processing devices. Non-limiting examples of the processor 402 may include a Field-Programmable Gate Array ("FPGA"), an application-specific integrated circuit ("ASIC"), a microprocessor, etc. The non-volatile memory 404 may include any type of memory device that retains stored information when powered off. Non-limiting examples of the memory 404 may include electrically erasable and programmable read-only memory ("EEPROM"), a flash memory, or any other type of non-volatile memory. In some examples, at least some of the memory 404 may include a medium from which the processor 402 can read the instructions 406. A computer-readable medium may include electronic, optical, magnetic, or other storage devices capable of providing the processor 402 with computer-readable instructions or other program code (e.g., instructions 406). Non-limiting examples of a computer-readable medium include (but are not limited to) magnetic disks(s), memory chip(s), ROM, random-access memory ("RAM"), an ASIC, a configured processor, optical storage, or any other medium from which a computer processor can read the instructions 406. The instructions 406 may include processor-specific instructions generated by a compiler or an interpreter from code written in any suitable computer-programming language, including, for example, C, C++, C#, etc.

In some examples, at least some of the memory 404 may include a medium from which the processor 402 can read the instructions 406. In some examples, the computing device 400 may determine an input for the instructions 406 based on sensor data 408 from the position sensor 220 and the strain gauge 222, data input into the computing device 400 by an operator, or other input means. For example, the position sensor 220 or the strain gauge 222 may measure a parameter (e.g., the position of the crankshaft 208, strain in the chamber 206) associated with the pump 100 and transmit associated signals to the computing device 400. The computing device 400 may receive the signals, extract data from the signals, and store the sensor data 408 in memory 404.

In additional aspects, the computing device 400 may determine an input for the instructions 406 based on pump data 410 stored in the memory 404. In some aspects, the pump data 410 may be stored in the memory 404 in response to previous determinations by the computing device 400. For example, the processor 402 may execute instructions 406 to cause the processor 402 to perform pump-monitoring tasks related to the flow rate of the pump 100 and may store flow-rate information that is received during monitoring of the pump 100 as pump data 410 in the memory 404 for further use (e.g., calibrating the pressure pump). In additional aspects, the pump data 410 may include other known information, including, but not limited to, the position of the position sensor 220 or the strain gauge 222 in or on the pump 100. For example, the computing device 400 may use the position of the position sensor 220 on the power end 202 to interpret the position signals received from the position sensor 220 (e.g., as a signal created by a moving bolt pattern).

In some aspects, the computing device 400 may generate graphical interfaces associated with the sensor data 408 or pump data 410, and information generated by the processor 402 therefrom, to be displayed via a display unit 412. The display unit 412 may be coupled to the processor 402 and may include any CRT, LCD, OLED, or other device for displaying interfaces generated by the processor 402. In some aspects, the computing device 400 may also generate an alert or other communication of the performance of the pump 100 based on determinations by the computing device 400 in addition to, or instead of, the graphical interfaces. For example, the display unit 412 may include audio components to emit an audible signal when certain conditions are present in the pump 100 (e.g., when the efficiency of one of the pumps 100, 102, 104 of FIG. 1 is compromised).

The computing devices 400 for each of the subsystems 122, 124, 126, 128 are communicatively coupled to the controller 130. The controller 130, similar to the computing device includes a processor 414, a memory 416, and a display 422. The processor 414 and the memory 416 may be similar in type and operation to the processor 402 and the memory 404 of the computing device 400. The processor 414 may execute instructions 418 stored in the memory 416 for receiving and processing information received from the subsystems 122, 124, 126, 128. In some examples, at least some of the memory 416 may include a medium from which the processor 414 can read the instructions 418. In additional aspects, the processor 414 may determine an input for the instructions 418 based on data 420 stored in the memory 416. In some aspects, the data 420 may be stored in the memory 416 in response to previous determinations by the controller 130. For example, the processor 414 may execute instructions 418 to cause the processor 414 to analyze and determine flow rates for the pumps 100 and proppant and additive concentrations for the fluid in the blender 108. The processor 414 may also transmit control signals to the subsystems 124, 126, 126, 128 to adjust the operations of the pumps 100, 102, 104 and the blender 108.

Figure 5:
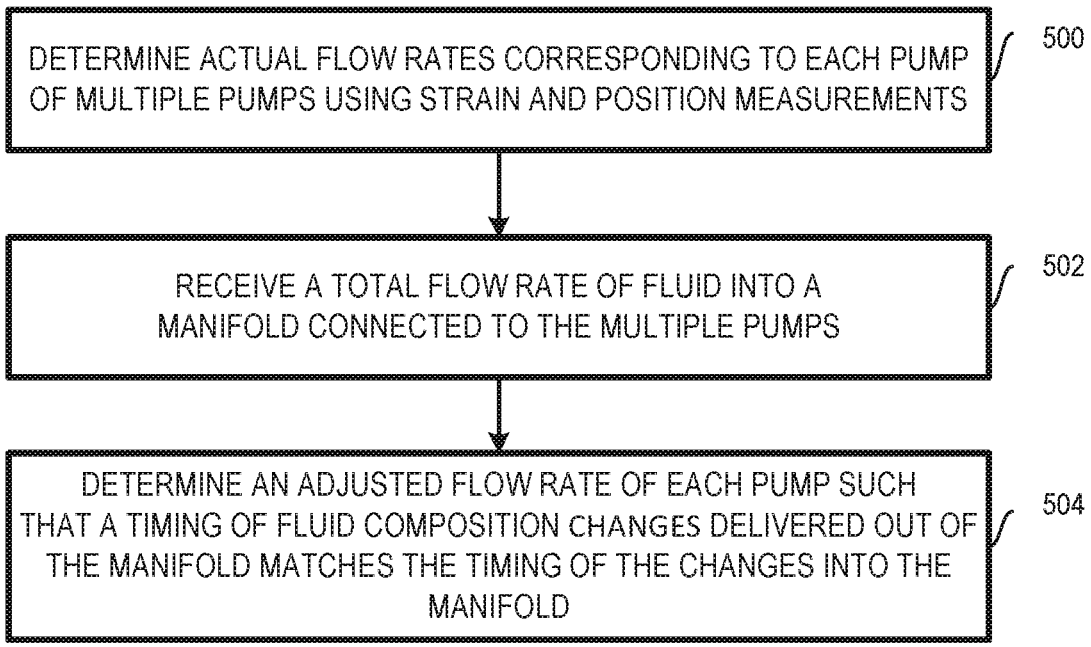
FIG. 5 is a flow chart of an example of a process for adjusting a flow rate of pressure pumps according to one aspect of the present disclosure.

FIG. 5 is a flow chart of an example of a process for adjusting a flow rate of pressure pumps according to one aspect of the present disclosure. The process is described with respect to FIGS. 1-4, though other implementations are possible without departing from the scope of the present disclosure.

In block 500, actual flow rates through the pumps 100, 102, 104 are determined. In some aspects, the actual flow rate of the fluid through the pumps 100, 102, 104 may be determined using position measurements and strain measurements of the position sensor 220 and the strain gauge 222 of FIG. 2, respectively. The actual flow rate through the pumps 100, 102, 104 may be determined from the flow rate of fluid into or out of the chamber 206 through the suction valve 216 or the discharge valve 218, respectively. In some aspects, the flow rates for each pump 100, 102, 104 may be determined by the computing device 400 for each pump 100, 102, 104. In other aspects, the actual flow rates may be determined by the controller 130.

In block 502, a total flow rate of fluid into the manifold trailer 106 is received. The total flow rate may correspond to the flow rate of fluid into the inlet manifold 300 from the blender 108. In some aspects, the total flow rate into the inlet manifold 300 may be received by the computing device 400 for one or more of the pumps 100, 102, 104. In other aspects, the total flow rate may be received by the controller 130. The total flow rate may include a desired total flow rate received based on an input from a wellbore operator. For example, in some aspects, a desired flow rate of 25 barrels per minute (bpm) may be input as data 420 into the memory 416 of the controller 130.

In block 504, adjusted flow rates for the pumps 100, 102, 104 are determined. The adjusted flow rates correspond to the flow rates for each of the pumps 100, 102, 104 that may be necessary to cause the timing of the fluid delivery into the manifold trailer 106 to match the timing of the fluid delivery out of the manifold trailer 106. In some aspects, the adjusted flow rates may be determined based on the total flow rate into the manifold trailer 106. The controller 130 or the computing device 400 corresponding to the pumps 100, 102, 104 may determine an individual flow rate corresponding to each of the pumps 100, 102, 104. The actual flow rates determined in block 500 may subsequently be adjusted to correspond to the adjusted flow rates to balance the pumps 100, 102, 104.

Figure 6:
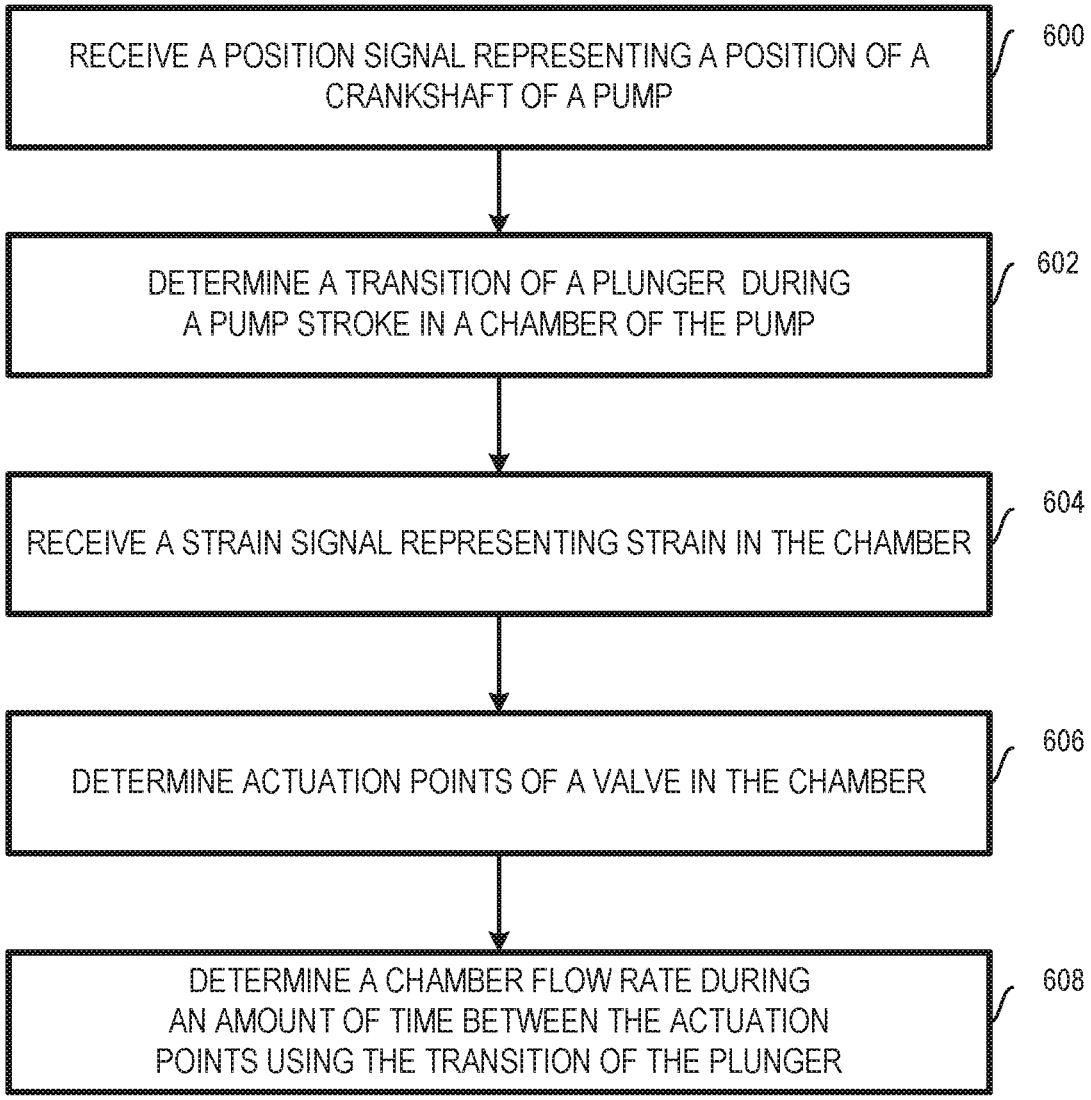
FIG. 6 is a flow chart of an example of a process for determining actual flow rates of fluid through the pressure pumps described in the process of FIG. 5 according to one aspect of the present disclosure.

FIG. 6 is a flow chart of an example of a process for determining the actual flow rates of fluid through the pumps 100, 102, 104 according to one aspect of the present disclosure. The process is described with respect to FIGS. 1-4, though other implementations are possible without departing from the scope of the present disclosure. Also, the process is described with respect to pump 100, but may be used to determine the actual flow rate of each pump 100, 102, 104 in the wellbore environment.

In block 600, a position signal representing a position of the crankshaft 208 is received. In some aspects, the position signal may be received by the computing device 400 of the subsystem 122 connected to the pump 100. The position signal may be generated by the position sensor 220 and correspond to the position of a rotating component of a rotating assembly that is mechanically coupled to the plunger 214 in a known relationship. For example, the position sensor 220 may be positioned on a crankcase of the crankshaft 208 to generate signals corresponding to the position, or rotation, of the crankshaft 208.

Figure 7:
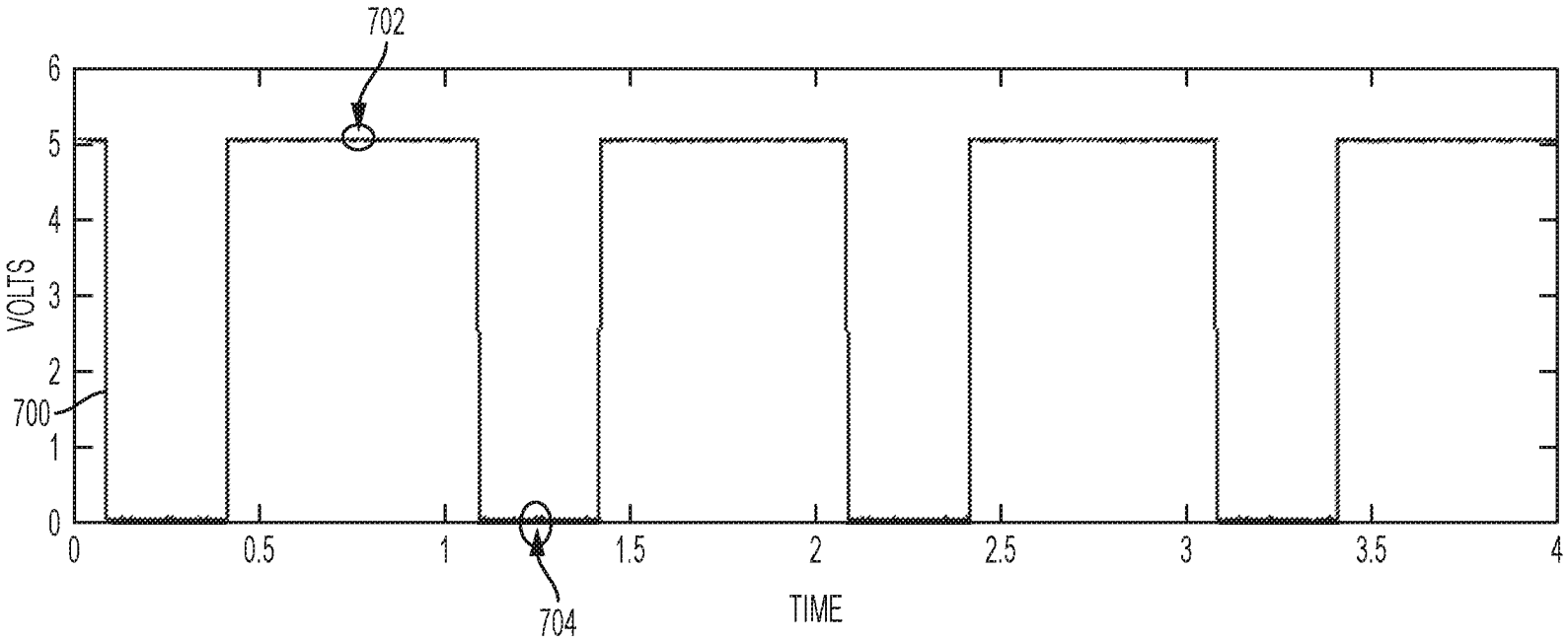
FIG. 7 is a signal graph depicting an example of a signal generated by a position sensor of the balancing system of FIG. 4 according to one aspect of the present disclosure.
Figure 8:
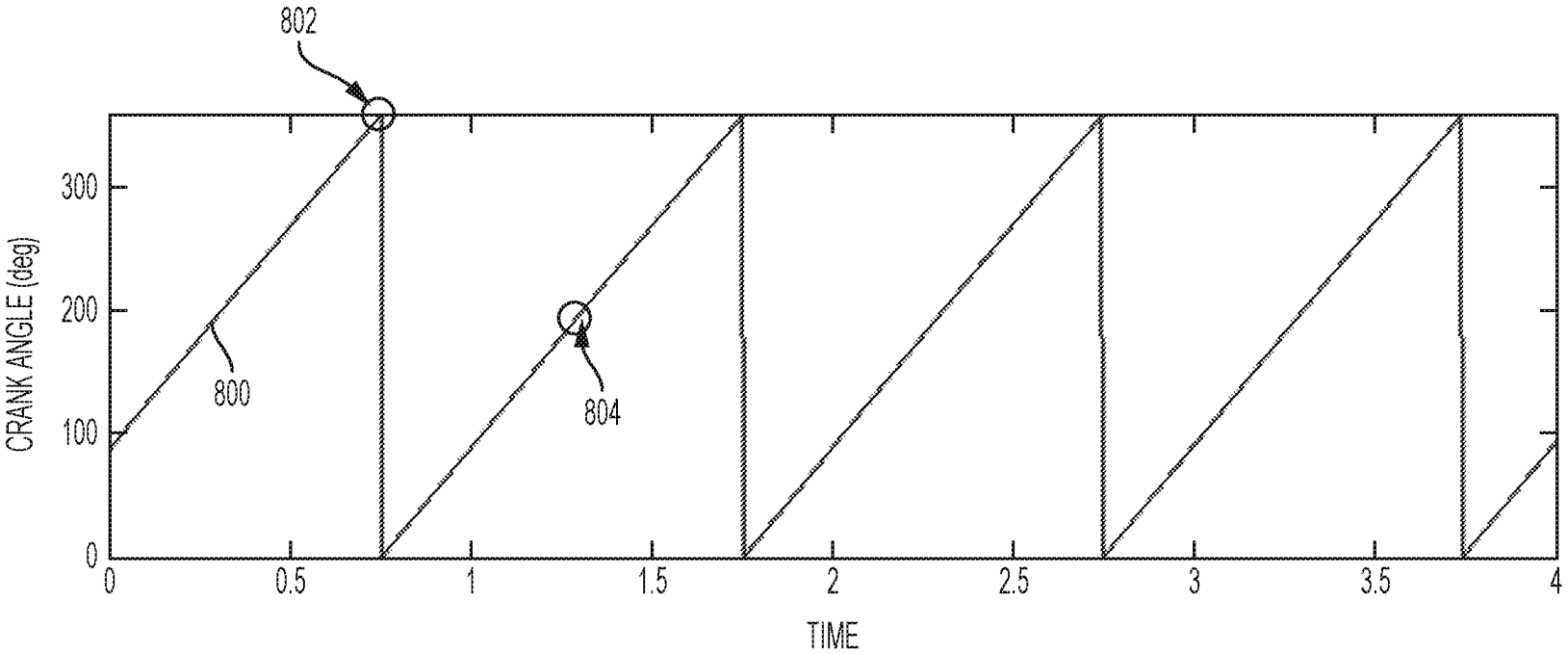
FIG. 8 is a signal graph depicting an example of another signal generated by a position sensor of the balancing system of FIG. 4 according to one aspect of the present disclosure.

In block 602, a transition of the plunger 214 is determined during a pump stroke of the plunger 214 in the chamber 206. FIGS. 7 and 8 show examples of position signals 700, 800 that may be generated by the position sensor 220 during operation of the pump 100. In some aspects, the position signals 700, 800 may represent the position of the crankshaft 208, which is mechanically coupled to the plunger 214 in the chamber 206. FIG. 7 shows a position signal 700 displayed in volts over time (in seconds). The position signal 700 may be generated by the position sensor 220 coupled to the power end 202 and positioned in a path of the crosshead 212. The position signal 700 may represent the position of the crankshaft 208 over the indicated time as the crankshaft 208 operates to cause the plunger 214 to move within the chamber 206.

In some aspects, the mechanical coupling of the plunger 214 to the crankshaft 208 may allow the computing device 400 to determine a position of the plunger 214 relative to the position of the crankshaft 208 based on the position signal 700. In some aspects, the computing device 400 may determine plunger-position reference points 702, 704 based on the position signal 800. For example, the processor 402 may determine dead center positions of the plunger 214 based on the position signal 700. The dead center positions may include the position of the plunger 214 in which it is farthest from the crankshaft 208, known as the top dead center. The dead center positions may also include the position of the plunger 214 in which it is nearest to the crankshaft 208, known as the bottom dead center. The distance between the top dead center and the bottom dead center may represent the length of a full pump stroke of the plunger 214 operating in the chamber 206.

The position signal between the top dead center and the bottom dead center may represent the movement of the crankshaft 208 during a full stroke of the plunger 214 in the chamber 206. In FIG. 7, the top dead center is represented by reference point 702 and the bottom dead center is represented by reference point 704. In some aspects, the processor 402 may determine the reference points 702, 704 by correlating the position signal 700 with a known ratio or other expression or relationship value representing the relationship between the movement of the crankshaft 208 and the movement of the plunger 214. For example, the mechanical correlations of the crankshaft 208 to the plunger 214 may be based on the mechanical coupling of the crankshaft 208 to the plunger 214 in the pump 100. The computing device 400 may determine the top dead center and bottom dead center based on the position signal 700 or may determine other plunger-position reference points to determine the position of the plunger over a full stroke of the plunger 214, or a pump cycle of the pump 100.

FIG. 8 shows a position signal 800 displayed in degrees over time (in seconds). The degree value may represent the rotational angle of the crankshaft 208 during operation of the crankshaft 208 or pump 100. In some aspects, the position signal 800 may be generated by the position sensor 220 located directly on the power end 202 (e.g., positioned directly on the crankshaft 208 or a crankcase of the crankshaft 208). The position sensor 220 may generate the position signal 800 based on the bolt pattern of the crankshaft 208 as the position sensor 220 rotates in response to the rotation of the crankshaft 208 during operation. Similar to the position signal 700 shown in FIG. 7, the computing device 400 may determine plunger-position reference points 802, 804 based on the position signal 800. The reference points 802, 804 represent the top dead center and bottom dead center of the plunger 214 for the chamber 206 during operation of the pump 100.

Returning to FIG. 6, in block 604 a strain signal is received. In some aspects, the strain signal may be received by the computing device 400. The strain signal may be generated by the strain gauge 222 and correspond to strain in the chamber 206.

Figure 9:
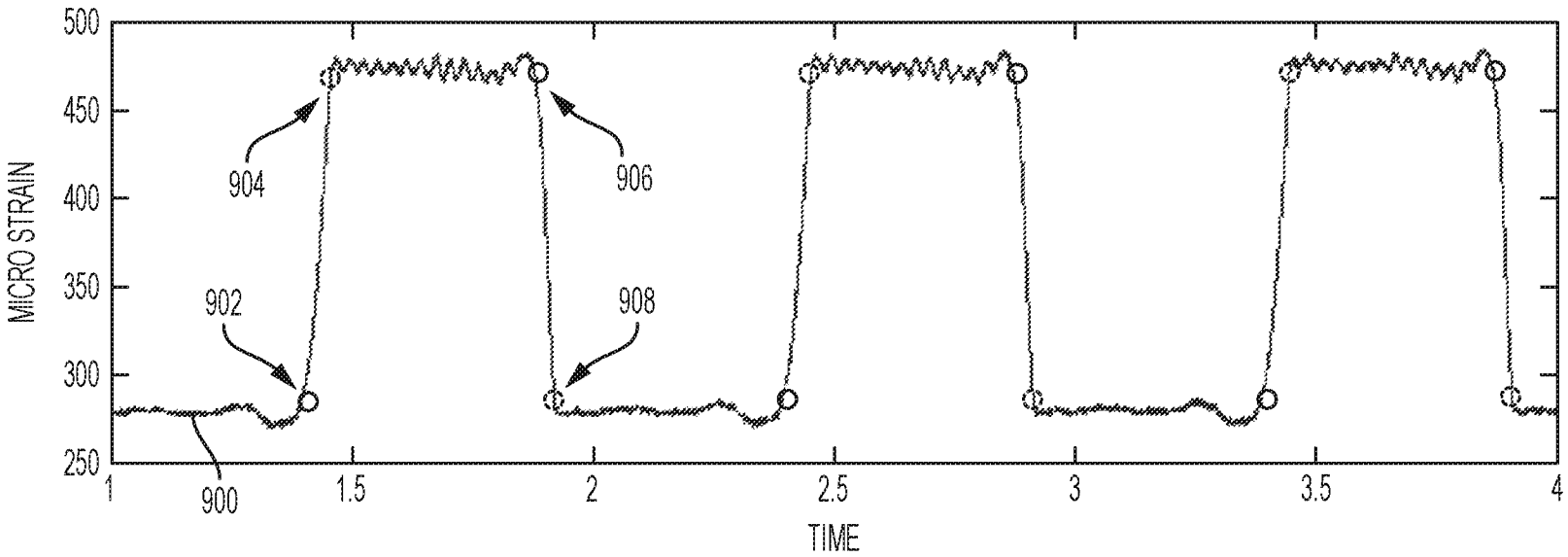
FIG. 9 is a signal graph depicting an example of a signal generated by a strain gauge of the balancing system of FIG. 4 according to one aspect of the present disclosure.

In block 606, actuation points of the suction valve 216 and the discharge valve 218 are determined using the strain signal. FIG. 9 shows an example of a strain signal 900 that may be generated by the strain gauge 222. In some aspects, the computing device 400 may determine actuation points 902, 904, 906, 908 of the suction valve 216 and the discharge valve 218 for the chamber 206 based on the strain signal 900. The actuation points 902, 904, 906, 908 represent the point in time where the suction valve 216 and the discharge valve 218 open and close. For example, the computing device 400 may execute instructions 406 including signal-processing processes for determining the actuation points 902, 904, 906, 908. The computing device 400 may execute instruction 406 to determine the actuation points 902, 904, 906, 908 from discontinuities in the strain signal 900 or other suitable means. In some aspects, the stress in the chamber 206 may change during the operation of the suction valve 216 and the discharge valve 218 to cause the discontinuities in the strain signal 900 during actuation of the valves 216, 218. The computing device 400 may identify these discontinuities as the opening and closing of the valves 216, 218.

In one example, the strain in the chamber 206 may be isolated to the fluid in the chamber 206 when the suction valve 216 is closed. The isolation of the strain may cause the strain in the chamber 206 to load up until the discharge valve 218 is opened. When the discharge valve 218 is opened, the strain may level until the discharge valve 218 is closed, at which point the strain may unload until the suction valve 216 is reopened. The discontinuities may be present when the strain signal 900 shows a sudden increase or decrease in value corresponding to the actuation of the valves 216, 218. Actuation point 902 represents the suction valve 216 closing, actuation point 904 represents the discharge valve 218 opening, actuation point 906 represents the discharge valve 218 closing, and actuation point 908 represents the suction valve 216 opening to resume the cycle of fluid into and out of the chamber 206. The exact magnitudes of strain or pressure in the chamber 206 determined by the strain gauge 222 may not be required for determining the actuation points 902, 904, 906, 908. The computing device 400 may determine the actuation points 902, 904, 906, 908 based on the strain signal 900 providing a characterization of the loading and unloading of the strain in the chamber 206.

Returning to FIG. 6, in block 608, a flow rate is determined during an amount of time between the actuation points. The flow rate may be determined for fluid flowing into the chamber 206 or flowing out of the chamber 206 using the position of the plunger 214 and its transition in the chamber 206 during the time between the actuation points 902, 904, 906, 908. For example, the time between the actuation points may correspond to a time where the suction valve 216 or the discharge valve 218 is in an open position.

Figure 10:
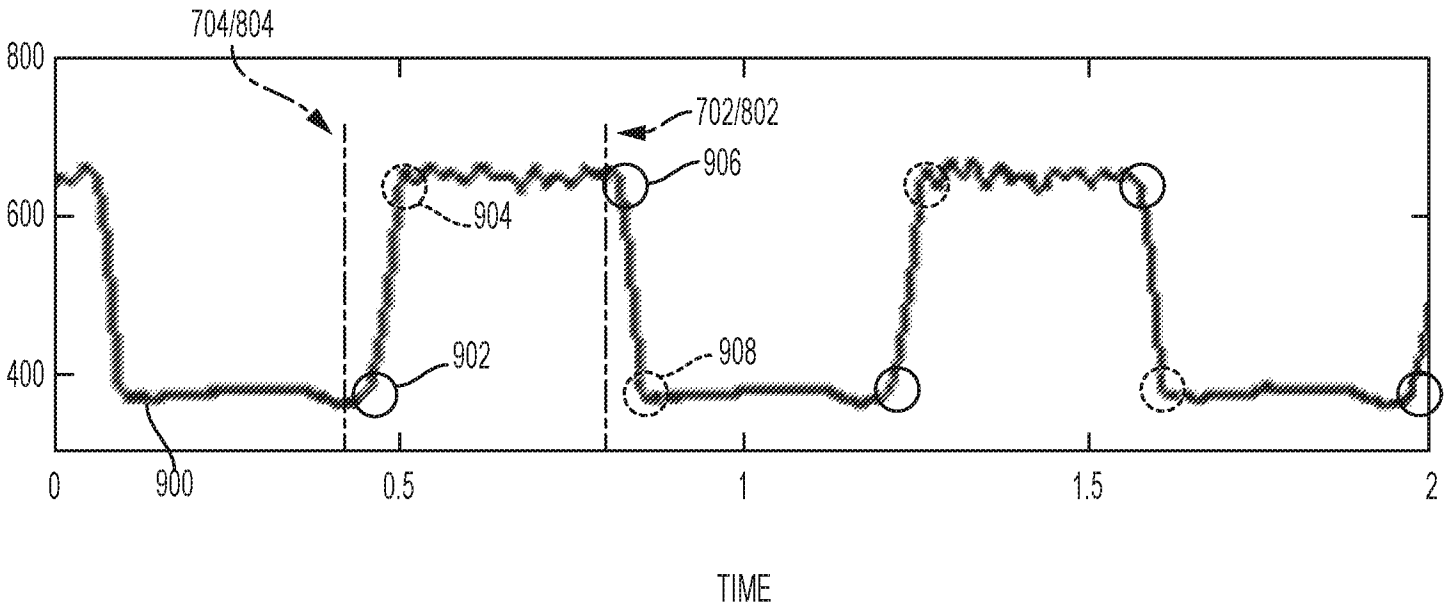
FIG. 10 is a signal graph depicting actuation of a suction valve and a discharge valve relative to the strain signal of FIG. 9 and a plunger position according to one aspect of the present disclosure.

In some aspects, the actuation points 902, 904, 906, 908 may be cross-referenced with the position signals 700, 800 to determine the position and movement of the plunger 214 in reference to the actuation of the suction valve 216 and the discharge valve 218. The cross-referenced actuation points 902, 904, 906, 908 and position signals 700, 800 may show an actual position of the plunger 214 at the time when each of the valves 216, 218 actuate. FIG. 10 shows the strain signal 900 of FIG. 9 with the actuation points 902, 904, 906, 908 of the valves 216, 218 shown relative to the position of the plunger 214. The actuation points 902, 904 are shown relative to the plunger 214 positioned at the bottom dead center (represented by reference points 704, 804) for closure of the suction valve 216 and opening of the discharge valve 218. The actuation points 906, 908 are shown relative to the plunger 214 positioned at top dead center (represented by reference points 702, 802) for opening of the suction valve 216 and closing of the discharge valve 218.

The movement of the plunger 214 between the opening of the discharge valve 218 (e.g., actuation point 904) and the closing of the discharge valve 218 (e.g., actuation point 906) may correspond to the time when the discharge valve 218 is in an open position. During this time, fluid may flow from the chamber 206 into the output manifold 302. Fluid may not be discharged from the chamber 206 until the discharge valve 218 is opened at actuation point 904. Motion of the plunger 214 in the chamber 206 may displace fluid from the chamber 206 into the output manifold 302. The flow back of the fluid from the output manifold 302 back into the chamber 206 may be needed to close the discharge valve 218 as the plunger 214 completes its pump stroke. The flow back may be subtracted from the volume of fluid discharged into the output manifold 302 to provide an accurate account of the total fluid discharged into the output manifold 302 during a full stroke length of the plunger 214. To determine the flow rate of the fluid into the discharge valve 218 from the chamber 206, the position of the plunger 214 at the time of the discharge valve 218 closing (e.g., actuation point 906) may be subtracted from the position of the plunger 214 at the time of the discharge valve 218 opening (e.g. actuation point 904). The flow rate of the fluid from the chamber 206 into the output manifold 302 may correspond to the flow rate of the fluid through the pump 100.

In some aspects, the flow rate may be similarly determined based on the actuation of the suction valve 216. Specifically, the volume of fluid flowing from the intake manifold 300 into the chamber 206 between the opening of the suction valve 216 and the closing of the suction valve 216 may provide an accurate account of the total fluid entering the chamber 206. The fluid flowing back into the intake manifold 300 to close the suction valve 216 may be subtracted from the volume. To determine the flow rate of the fluid into the chamber 206, the position of the plunger 214 at the time the suction valve 216 closes may be subtracted from the position of the plunger 214 at the time the suction valve 216 opens. The flow rate of the fluid from the intake manifold 300 into the chamber 206 may correspond to the flow rate of the fluid through the pump 100.

Figure 11:
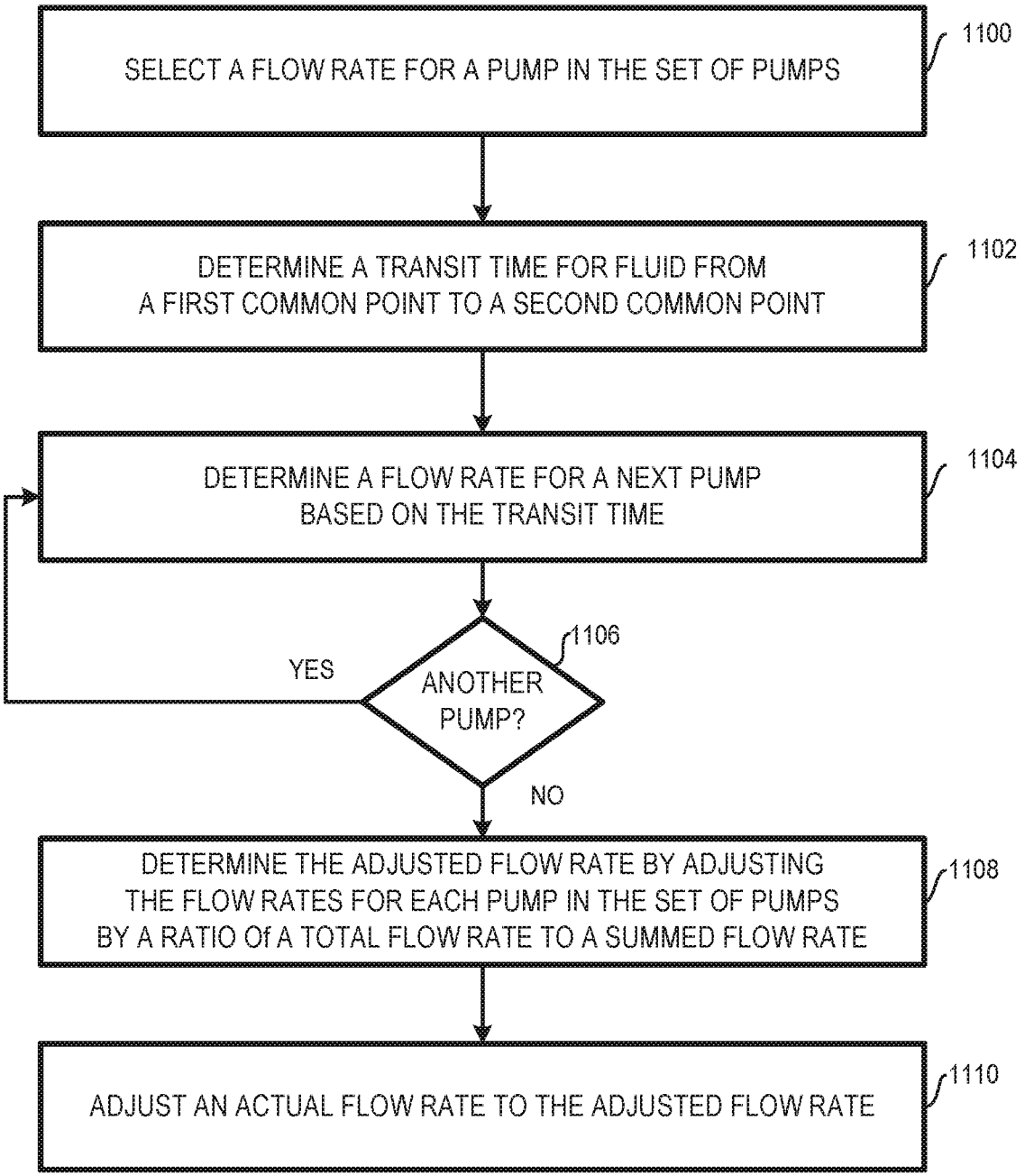
FIG. 11 is a flow chart of an example of a process for determining an adjusted flow rate of the pressure pumps described in the process of FIG. 5 according to one aspect of the present disclosure.

FIG. 11 is a flow chart of an example of a process for determining an adjusted flow rate of the pumps 100, 102, 104 according to one aspect of the present disclosure. The process is described with respect to FIGS. 1-4, though other implementations are possible without departing from the scope of the present disclosure.

In block 1100, a flow rate for one of the pumps 100, 102, 104 is selected. In some aspects, the selection of the flow rate for one of the pumps 100, 102, 104 may be an arbitrary selection. In other aspects, the selection may correspond to a ratio of the total flow rate into the manifold trailer 106. For example, the memory 416 of the controller 130 may include instructions 418 to cause the selected flow rate for one of the pumps 100, 102, 104 to be a predetermined fraction of the total flow rate (e.g., one half the total flow rate). In some aspects, the flow rate selected may correspond to the pump 100, 102 104 positioned the farthest distance from the inlet 304 and the outlet 306 (e.g., pump 104).

In block 1102, a transit time for fluid to travel through the manifold trailer 106 via the pump 104 (e.g., the pump positioned the farthest different from the inlet 304 of the intake manifold 300 and the outlet 306 of the output manifold 302) may be determined. For example, referring to FIG. 3, the transit time may correspond to the time it takes fluid to travel from the inlet 304 through the joints A, C, E, the pump 104, and the joints F, D, B to the outlet 306.

In some aspects, the instructions 418 stored in the memory 416 may include the following relationships for determining the transit times $T_{100}$, $T_{102}$, $T_{104}$ for fluid traversing flow paths through the pumps 100, 102, 104, respectively, excluding the common path elements between the inlet 304 and the joint A and between the joint B and the outlet 306. The transit time of each pipe segment is denoted by the variable $T_{XY}$, using the same XY subscripts as applied to the flow rate through the respective pipe segment. The pumps 100, 102, 104 are denoted by P1, P2, and P3 in the subscripts.

$$T_{100}=T_{AP1}+T_{P1B}$$

$$T_{102}=T_{AC}+T_{CP2}+T_{P2D}+T_{DB}$$

$$T_{104}=T_{AC}+T_{CE}+T_{EP3}+T_{P3F}+T_{FD}+T_{DB}$$

In some aspects, each pipe segment between the junctions A-F, and between the junctions A-F and each pump 100, 102, 104, may have a different length or diameter. The volume of each pipe may be at least one parameter of interest in determining the transit time of fluid in the pipes between the joints. In some aspects, the instructions 418 stored in the memory 416 may include the following relationships for determining the volume through each path. The volume in each segment in the paths is denoted by the variable $V_{XY}$, using the same XY subscripts as applied to the flow rate through the respective pipe segment.

$$V_{100}=V_{AP1}+V_{P1B}$$

$$V_{102}=V_{AC}+V_{CP2}+V_{P2D}+V_{DB}$$

$$V_{104}=V_{AC}+V_{CE}+V_{EP3}+V_{P3F}+V_{FD}+V_{DB}$$

In some aspects, the instructions 418 stored in the memory 416 may include the following relationships for determining the transit times $T_{100}$, $T_{102}$, $T_{104}$ using the volume of each path and the flow rate through the pumps 100, 102, 104.

$$T_{100}=V_{100}/F_{100}$$

$$T_{102}=V_{102}/F_{102}$$

$$T_{104}=V_{104}/F_{104}$$

In an example of determining a flow rate, the total flow rate for the pumps received in block 502 may be 25 bpm. The flow rate of pump 104 selected in block 1100 may be half of the total flow rate, or $F_{104}$=12.5 bpm. The volume of all pipe segments connected to a pump is 0.3 barrels and the volume of all pipe segments connected between the joints is 0.5 barrels. The volume of the pipe segments carrying only the fluid flow of pump 104 is $V_{CD}=V_{CE}+V_{EP3}+V_{P3F}+V_{FD}$ along the flow path between the joints C, D through the pump 104. Therefore, the transit time along the flow path between the joint C, D through the pump 104 is:

$$T_{CD}=\frac{V_{CD(104)}}{F_{104}}=\frac{(V_{CE}+V_{EP3}+V_{P3F}+V_{FD})}{F_{104}}=\frac{0.5+0.3+0.3+0.5}{12.5}=0.128\text{ mins}$$

Returning to FIG. 11, in block 1104, a flow rate for the pump 102 is determined based on the transit time for the pump 104. In some aspects, the flow rate for the pump 102 may be determined by identifying the necessary flow rate to cause the fluid to flow through the pump 102 during the same transit time as the fluid flowing through the pump 104 between the same joints. Using the same example, the transit time between the joints C, D through pump 104 was determined to be 0.128 minutes. Therefore, the flow rate between the joints C, D through the pump 102 is:

$$F_{102}=\frac{V_{CD(102)}}{T_{CD}}=\frac{V_{CP2}+V_{P2D}}{T_{CD}}=\frac{0.3+0.3}{0.128}=4.69\ bpm$$

In decision block 1106, a determination is made as to whether another pump is fluidly connected to the manifold trailer 106. In some aspects, the data 420 may include one or more values corresponding to the pumps 100, 102, 104 fluidly coupled to the manifold trailer 106, including but not limited to the number of pumps or an identity of the pumps. The controller 130 may determine whether additional pumps are included using a counter, identifier, or other means using the pump data 410.

Upon determining that another pump is fluidly connected to the manifold trailer 106, the process may return to block 1104 to determine a flow rate for the next pump 100 using the transit time for the fluid from the pump 104. Since the pump 100 includes additional pipe segments in the flow path, the transit time from the common joints (here, joints A, B) must be calculated for the pump 104. Using the same example, the transit time along the flow path between the joint A, B through the pump 104 is:

$$T_{AB}=\frac{V_{AB(104)}}{F_{104}}=\frac{(V_{AC}+V_{CE}+V_{EP3}+V_{P3F}+V_{FD}+V_{DB})}{F_{104}}=\frac{0.5+0.5+0.3+0.3+0.5+0.5}{12.5}=0.208\text{ mins}$$

The transit time along the flow path between the joint A, B through the pump 104 may be used to identify the necessary flow rate to cause the fluid to flow through the pump 100 during the same transit time as the fluid flowing through the pump 104 between the same joints A, B. Therefore, the flow rate between the joints A, B through the pump 100 is:

$$F_{100}=\frac{V_{AB(100)}}{T_{AB}}=\frac{V_{AP1}+V_{P1A}}{T_{AB}}=\frac{0.3+0.3}{0.208}=2.88\ bpm$$

The steps of blocks 1104, 1106 may be repeated until the flow rate for all of the pumps 100, 102, 104 fluidly connected to the manifold trailer 106 are determined.

Upon determining that there are no additional pumps in block 1106, the process may proceed to block 1108 where adjusted flow rates are determined based on the flow rates determined in block 1104. In some aspects, the adjusted flow rates may be determined for each of the pumps 100, 102, 104 by adjusting the identified flow rates by a ratio of the total flow rate into the manifold to a summed flow rate to yield the adjusted flow rate. Completing the example, the flow rates for each of the pumps 100, 102, 104 was determined as $F_{100}$=2.88, $F_{102}$=4.69, and $F_{104}$=12.5, respectively. The sum of the flow rates is $F_{100}+F_{102}+F_{104}$. Adjusting the flow rates by the ratio of the total flow rate (e.g., 25 bpm) to the summed flow rate results in an adjusted rate, $F_A$, for each pump 100, 102, 104, respectively is:

$$F_{A(100)}=F_{100}\times\frac{\text{Total Flow Rate}}{\text{Summed Flow Rate}}=2.88\times\frac{25}{(2.88+4.69+12.5)}=3.59\ bpm$$

-continued $$F_{A(102)} = F_{102} \times \frac{\text{Total Flow Rate}}{\text{Summed Flow Rate}} = 4.69 \times \frac{25}{(2.88 + 4.69 + 12.5)} = 5.84\ bpm$$

$$F_{A(104)} = F_{104} \times \frac{\text{Total Flow Rate}}{\text{Summed Flow Rate}} = 12.5 \times \frac{25}{(2.88 + 4.69 + 12.5)} = 15.57\ bpm$$

In block 1110, the flow rates for each of the pumps 100, 102, 104 may be adjusted to the adjusted flow rate determined in block 1108. In some aspects, the controller 130 may transmit a control signal to the computing device 400 to cause the processor 402 to increase the flow rate of the pumps 100, 102, 104 to the adjusted flow rates from the actual flow rates determined in block 500 of FIG. 5.

Figure 12:
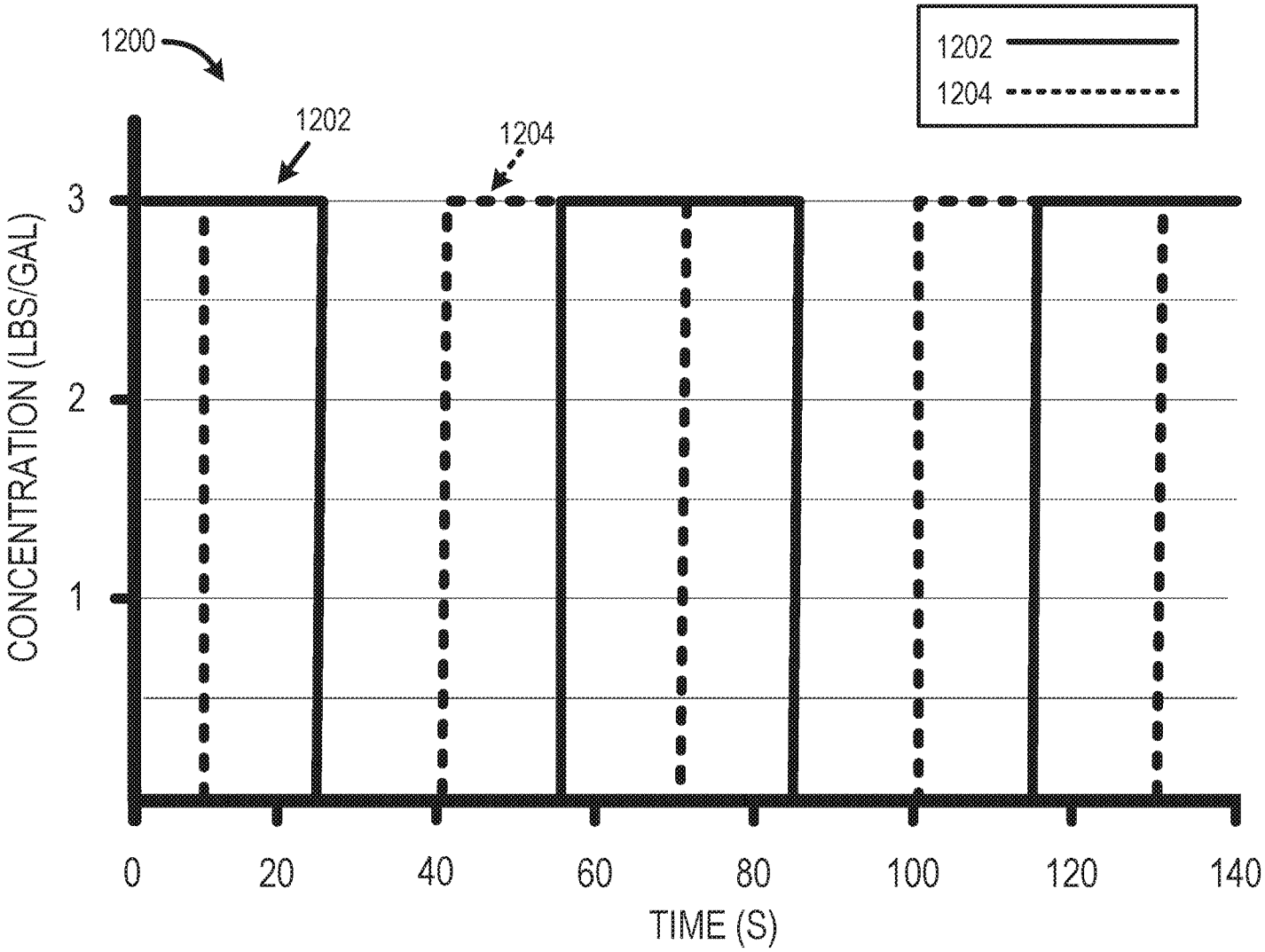
FIG. 12 is a plot graph depicting fluid delivery from a manifold trailer of FIG. 3 according to one aspect of the present disclosure.

FIG. 12 is a plot graph 1200 depicting fluid delivery from a manifold trailer 106 according to one aspect of the present disclosure. A command profile 1202 representing the proppant concentration of the fluid entering the inlet 304 of the intake manifold 300 is shown as changing from zero to 3 pounds per gallon (lbs/gal), or about 299 kilograms per cubic meter (kg/m$^3$) in a first step-change. The command profile 1202 then holds at 3 lbs/gal for 30 seconds before going back to zero in a second step-change. As the transit times for each of the pumps 100, 102, 104 are the same, the delivered proppant concentration 1204 shows substantially the same step-change as the command profile 1202, with a slight offset in time. As shown in FIG. 12, the step-changes may create a square-wave pulse representing the intervaled compositions of the fluid flowing through the pumps 100, 102, 104 to the wellhead 116. In some aspects, fluid properties (e.g., compressibility, bulk modulus, etc.) may be monitored to ensure that the integrity of the step-change remains intact from the wellhead 116 to the formation 120 downhole adjacent to the wellbore 118. Monitoring fluid properties may allow the flow rates of the pumps 100, 102, 104 to be adjusted to compensate for any fluid properties that may affect the integrity of the step-change. In additional aspects, the controller 130 or the computing device 400 may use data 420 and pump data 410, respectively, stored from input of the operator or measurements used to balance the pumps 100, 102, 104 to determine the fluid properties.

In some aspects, systems and methods may be used according to one or more of the following examples:

Example 1: A system may include a plurality of strain gauges positionable on a plurality of pressure pumps to measure strain in chambers of the plurality of pressure pumps. The system may also include a plurality of position sensors positionable on the plurality of pressure pumps to measure positions of rotating members of the plurality of pressure pumps. The system may also include one or more computing devices communicatively couplable to the plurality of strain gauges and the plurality of position sensors to determine an adjustment to a flow rate of fluid through at least one pump of the plurality of pumps using a strain measurement and a position measurement for the at least one pump such that a timing of changes in composition of the fluid delivered to a first manifold at an input for the plurality of pressure pumps matches the timing of the changes in composition of the fluid delivered from an output for the plurality of pressure pumps.

Example 2: The system of example 1 may feature the one or more computing devices including at least a processing device and a non-transitory memory device on which instructions are stored and executable by the processing device to cause the processing device to determine the adjustment to the flow rate of fluid through the at least one pump by (1) determining an actual flow rate for the at least one pump using the strain measurement and the position measurement for the at least one pump; (2) receiving a total flow rate of fluid into a first manifold at an inlet to the plurality of pressure pumps; and (3) determining an adjusted flow rate for the at least one pump that causes the timing of the changes in the composition of the fluid delivered out of a second manifold to match timing of the changes in the composition of the fluid delivered into the inlet.

Example 3: The system of examples 1-2 may feature the at least one pump including a first pump. The system may also feature the memory device including instructions that are executable by the processing device to cause the processing device to determine the adjusted flow rate for the first pump by (1) identifying a first rate for a first flow of the respective fluid through a first flow path extending from a first common point in the first manifold, through a second pump of the plurality of pressure pumps, and to a second common point in the second manifold; (2) determining a first transit time for the first flow of the respective fluid through the first flow path; (3) determining a second rate for a second flow of the respective fluid between the first common point and the second common point, a second transit time of the second flow of the respective fluid through a second flow path extending from the first common point, through the first pump, and to the second common point being equal to the first transit time; and (4) determining an adjusted second rate by adjusting the second rate by a ratio of the first total flow rate into the first manifold to a summed flow rate including the first rate and the second rate.

Example 4: The system of examples 1-3 may feature the instructions being executable by the processing device to cause the processing device to determine the first transit time by determining a first fluid volume within the first flow path and dividing the first fluid volume by the first rate.

Example 5: The system of examples 1-4 may feature the memory device including instructions that are executable by the processing device to determine the actual flow rate for the at least one pump by (1) determining a transition of a plunger during a pump stroke in a chamber of the at least one pump using a position signal generated by a position sensor of the plurality of position sensors and corresponding to the position of the respective rotating member in the at least one pump; (2) determining actuation points of a valve in the chamber using a strain signal generated by a strain gauge of the plurality of strain gauges and corresponding to the strain in the chamber during the pump stroke; and (3) determining a chamber flow rate of fluid through the valve between the actuation points based on the transition of the plunger.

Example 6: The system of examples 1-5 may feature the memory device including instructions that are executable by the processing device to determine the transition of the plunger by correlating the position of the respective rotating member with an expression representing a mechanical correlation of the plunger to the respective rotating member during a pump cycle of the at least one pump.

Example 7: The system of example 1-6 may feature the memory device including instructions that are executable by the processing device to determine the actuation points by identifying at least two discontinuities in the strain signal subsequent to a loading or unloading of the strain in the chamber.

Example 8: The system of examples 1-7 may feature the memory device including instructions that are executable by the processing device to determine the chamber flow rate by determining a volume of the respective fluid through the valve in response to the transition of the plunger during an open period of the valve.

Example 9: The system of examples 1-8 may feature the one or more computing devices including: (1) a first set of pump-computing devices communicatively couplable to the plurality of pressure pumps to control flow rates for each pump of the plurality of pressure pumps; (2) a blender-computing device communicatively couplable to a blender to control a concentration of proppant mixed into the fluid entering the first manifold from the blender; and (3) a controller device communicatively coupled to the first set of pump-computing devices and the blender-computing device to transmit control signals corresponding to instructions for controlling the flow rates and the concentration of proppant.

Example 10: A method may include determining actual flow rates for a plurality of pressure pumps using measurements from a strain gauges and position sensors positioned on the plurality of pressure pumps. The method may also include receiving a total flow rate of fluid into a first manifold at an input of the plurality of pressure pumps. The method may also include determining adjusted flow rates for the plurality of pressure pumps that cause a timing of changes in composition of the fluid out of a second manifold at an output of the plurality of pressure pumps to match the timing of the changes in composition of the fluid into the first manifold.

Example 11: The method of example 10 may feature determining the adjusted flow rates to include: (1) identifying a first flow rate of a first pump of the plurality of pumps; (2) determining a first transit time for a first respective fluid to flow through a first flow path extending from a first common point in the first manifold, through the first pump, and to a second common point in the second manifold; (3) determining a second flow rate for a second respective fluid to flow through a second flow path extending from the first common point, through a second pump, and to the second common point at a second transit time that is equal to the first transit time; and (4) determining an adjusted second flow rate by adjusting the second flow rate by a ratio of the total flow rate to a summed flow rate including the first flow rate and the second flow rate.

Example 12: The method of examples 10-11 may also include determining a new transit time for the first respective fluid to flow through a new flow path extending from a new common point in the first manifold, through the first pump, and to a new second common point in the second manifold. The method may also include determining a third flow rate for a third respective fluid to flow through a third flow path extending from the new common point, through the third pump, and to the new second common point at a third transit time that is equal to the new transit time. The method may also include determining an adjusted third flow rate by adjusting the third flow rate by a ratio of the total flow rate to the summed flow rate including the first flow rate, the second flow rate, and the third flow rate.

Example 13: The method of examples 10-12 may feature the plurality of pumps being positioned in parallel between the first manifold and the second manifold. The first pump may be positioned farther from the inlet of the first manifold and the outlet of the second manifold than the second pump, wherein the second pump is positioned farther from the inlet and the outlet than the third pump.

Example 14: The method of examples 10-13 may feature determining actual flow rates for a pump of the plurality of pressure pumps to include: (1) receiving a position signal representing the position measurement and corresponding to a position of a rotating member of the pump; (2) receiving a strain signal representing the strain measurement and corresponding to strain in a chamber of the pump; (3) determining, using the position signal, a transition of a plunger mechanically coupled to the rotating member during a pump stroke of the plunger in the chamber; (4) determining, using the strain signal, actuation points of a valve in the chamber of the pump, the actuation points including a first actuation point corresponding to a beginning of the pump stroke and a second actuation point corresponding to an ending of the pump stroke; and (5) determining a chamber flow rate of fluid through the valve between the actuation points based on the transition of the plunger.

Example 15: The method of example 10-14 may feature determining the transition of the plunger to include correlating the position of the rotating member with an expression representing a mechanical correlation of the plunger to the rotating member.

Example 16: The method of example 10-15 may feature determining the actuation points to include identifying discontinuities in the strain signal subsequent to a loading or unloading of the strain in the chamber.

Example 17: A system may include a blender fluidly couplable to an inlet of a first manifold to deliver intervals of fluid mixtures to the first manifold at a total flow rate into the first manifold. The intervals may include a first interval of a first fluid mixture having a first concentration of proppant and a second interval of a second fluid mixture having a second concentration of proppant that is different than the first concentration of proppant. The system may also include a plurality of pressure pumps fluidly couplable to the first manifold at an input of the plurality of pressure pumps to receive the intervals of the fluid mixture, the plurality of pressure pumps including at least one pump operable to adjust a flow rate of fluid through the at least one pump using a strain measurement and a position measurement for the at least one pump such that a timing pattern of the intervals of the fluid mixtures out of a second manifold at an output of the plurality of pressure pumps matches the timing pattern into the first manifold.

Example 18: The system of example 17 may also include a wellhead positionable proximate to a wellbore. The wellhead may be fluidly couplable to an outlet of the second manifold to receive the intervals of the fluid mixtures at the timing pattern and inject the intervals of the fluid mixtures into the wellbore at the timing pattern to fracture a subterranean formation adjacent to the wellbore.

Example 19: The system of examples 17-18 may feature the plurality of pressure pumps are positionable in parallel between the first manifold and the second manifold, wherein the plurality of pressure pumps includes at least a first pump, a second pump, and a third pump. The first pump may be positionable farther from the inlet of the intake manifold and an outlet of the output manifold than the second pump. The second pump may be positionable farther from the inlet and the outlet than the third pump.

Example 20: The system of examples 17-19 may also include a strain gauge positionable on the at least one pump to generate a strain signal representing the strain measurement and corresponding to strain in a chamber of the at least one pump. The system may also include a position sensor positionable on the at least one pump to generate a position signal representing the position measurement and corresponding to a position of a rotating member of the at least one pump. The system may also include at least one processing device communicatively couplable to the strain gauge and the position sensor to (1) determine an actual flow rate through the at least one pump by using the strain signal and the position signal to determine a rate of fluid flowing into the chamber during a stroke of a displacement member mechanically coupled to the rotating member, and (2) determine, using the total flow rate into the first manifold, an adjusted flow rate through the at least one pump that causes the timing pattern of the intervals out of the second manifold to match the timing pattern of the intervals into the first manifold.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A system, comprising:

a plurality of strain gauges positioned on a plurality of pressure pumps to measure strain in chambers of the plurality of pressure pumps;

a plurality of position sensors positioned on the plurality of pressure pumps to measure positions of rotating members of the plurality of pressure pumps; and one or more computing devices communicatively couplable to the plurality of strain gauges and the plurality of position sensors, the one or more computing devices including one or more processing devices and one or more non-transitory computer-readable mediums, the one or more non-transitory computer-readable mediums comprising instructions that are executable by the one or more processing devices for causing the one or more processing devices to:

determine an actual flow rate of fluid through at least one pump of the plurality of pressure pumps by:

determining a transition of a plunger during a pump stroke in a chamber of the at least one pump using a position signal generated by a position sensor of the plurality of position sensors, the position signal corresponding to the position of a respective rotating member in the at least one pump;

determining actuation points of a valve in the chamber by identifying at least two discontinuities in a strain signal generated by a strain gauge of the plurality of strain gauges subsequent to a loading or unloading of the strain in the chamber during the pump stroke; and determining a chamber flow rate of fluid through the valve based on the determined actuation points and the transition of the plunger; and determine an adjustment to the actual flow rate of fluid through the at least one pump of the plurality of pressure pumps, wherein the adjustment is configured such that a timing of changes in composition of the fluid delivered to a first manifold at an input for the plurality of pressure pumps matches the timing of the changes in composition of the fluid delivered from an output for the plurality of pressure pumps.

2. The system of claim 1, wherein the instructions are further executable by the one or more processing devices to cause the one or more processing devices to determine the adjustment to the flow rate of the fluid through the at least one pump by:

receiving a total flow rate of the fluid into the first manifold at an inlet to the plurality of pressure pumps; and based on the total flow rate, determining an adjusted flow rate for the at least one pump that causes the timing of the changes in the composition of the fluid delivered out of a second manifold to match timing of the changes in the composition of the fluid delivered into the inlet.

3. The system of claim 2, wherein the total flow rate is a first total flow rate, wherein the at least one pump includes a first pump, and wherein the instructions are further executable by the one or more processing devices to cause the one or more processing device to determine the adjusted flow rate for the first pump by:

identifying a first rate for a first flow of the respective fluid through a first flow path extending from a first common point in the first manifold, through a second pump of the plurality of pressure pumps, and to a second common point in the second manifold;

determining a first transit time for the first flow of the respective fluid through the first flow path;

determining a second rate for a second flow of the respective fluid between the first common point and the second common point, wherein a second transit time of the second flow of the respective fluid through a second flow path extending from the first common point, through the first pump, and to the second common point is equal to the first transit time; and determining an adjusted second rate by adjusting the second rate by a ratio of the first total flow rate into the first manifold to a summed flow rate including the first rate and the second rate.

4. The system of claim 3, wherein the instructions are further executable by the one or more processing devices to cause the one or more processing devices to determine the first transit time by determining a first fluid volume within the first flow path and dividing the first fluid volume by the first rate.

5. The system of claim 1, wherein the instructions are further executable by the one or more processing devices for causing the one or more processing devices to:

determine the transition of the plunger by correlating the position of the respective rotating member with an expression representing a mechanical correlation of the plunger to the respective rotating member during a pump cycle of the at least one pump.

6. The system of claim 1, wherein the instructions are further executable by the one or more processing devices for causing the one or more processing devices to:

determine the chamber flow rate by determining a volume of the respective fluid through the valve in response to the transition of the plunger during an open period of the valve.

7. The system of claim 1, wherein the one or more computing devices includes:

a first set of pump-computing devices communicatively couplable to the plurality of pressure pumps to control flow rates for each pump of the plurality of pressure pumps;

a blender-computing device communicatively couplable to a blender to control a concentration of proppant mixed into the fluid entering the first manifold from the blender; and a controller device communicatively coupled to the first set of pump-computing devices and the blender-computing device to transmit control signals corresponding to instructions for controlling the flow rates and the concentration of proppant.

8. The system of claim 1, wherein the instructions are further executable by the one or more processing devices to cause the one or more processing devices to:

determine a first volume of fluid flowing from an intake manifold into the chamber between an opening of a suction valve and a closing of the suction valve;

determine a second volume of fluid flowing back from the chamber into the intake manifold to close the suction valve; and determine a volume of fluid in the chamber by subtracting the second volume from the first volume.

9. The system of claim 8, wherein the instructions are further executable by the one or more processing devices to cause the one or more processing devices to:

determine a first position of the plunger when the suction valve closed;

determine a second position of the plunger when the suction valve opened;

determine a change in a plunger position by subtracting the first position from the second position; and determine the actual flow rate of the fluid through the chamber based on the volume of fluid in the chamber and the change in plunger position.

10. A method, comprising:

determining, by one or more processing devices, an actual flow rate of a fluid through at least one pump among a plurality of pressure pumps by:

determining a transition of a plunger in the at least one pump during a pump stroke in a chamber of the at least one pump using a position signal generated by a position sensor among a plurality of position sensors coupled to the plurality of pressure pumps, the position signal corresponding to a position of a respective rotating member in the at least one pump;

determining actuation points of a valve in the chamber by identifying at least two discontinuities in a strain signal generated by a strain gauge subsequent to a loading or unloading of strain in the chamber of the at least one pump during the pump stroke, wherein the strain gauge is part of a plurality of strain gauges coupled to the plurality of pressure pumps and the strain signal corresponds to strain in the chamber of the at least one pump, and wherein the actuation points include a first actuation point corresponding to a beginning of the pump stroke and a second actuation point corresponding to an ending of the pump stroke; and determining a chamber flow rate of fluid through the valve based on the determined actuation points and the transition of the plunger;

receiving a total flow rate of the fluid into a first manifold at an input of the plurality of pressure pumps; and determining, based on the actual flow rate and the total flow rate, adjusted flow rates for the plurality of pressure pumps that cause a timing of changes in composition of the fluid out of a second manifold at an output of the plurality of pressure pumps to match the timing of the changes in composition of the fluid into the first manifold.

11. The method of claim 10, wherein determining the adjusted flow rates includes:

identifying a first flow rate of a first pump of the plurality of pressure pumps;

determining a first transit time for a first respective fluid to flow through a first flow path extending from a first common point in the first manifold, through the first pump, and to a second common point in the second manifold;

determining a second flow rate for a second respective fluid to flow through a second flow path extending from the first common point, through a second pump, and to the second common point at a second transit time that is equal to the first transit time; and determining an adjusted second flow rate by adjusting the second flow rate by a ratio of the total flow rate to a summed flow rate including the first flow rate and the second flow rate.

12. The method of claim 11, further including:

determining a new transit time for the first respective fluid to flow through a new flow path extending from a new common point in the first manifold, through the first pump, and to a new second common point in the second manifold;

determining a third flow rate for a third respective fluid to flow through a third flow path extending from the new common point, through a third pump, and to the new second common point at a third transit time that is equal to the new transit time; and determining an adjusted third flow rate by adjusting the third flow rate by a ratio of the total flow rate to the summed flow rate including the first flow rate, the second flow rate, and the third flow rate.

13. The method of claim 12, wherein the plurality of pressure pumps are positioned in parallel between the first manifold and the second manifold, wherein the first pump is positioned farther from an inlet of the first manifold and an outlet of the second manifold than the second pump, wherein the second pump is positioned farther from the inlet and the outlet than the third pump.

14. The method of claim 10, wherein determining the transition of the plunger includes correlating the position of the respective rotating member with an expression representing a mechanical correlation of the plunger to the respective rotating member.

15. The method of claim 10, further comprising:

determining a first volume of fluid flowing from an intake manifold into the chamber between an opening of a suction valve and a closing of the suction valve;

determining a second volume of fluid flowing back from the chamber into the intake manifold to close the suction valve; and determining a volume of fluid in the chamber by subtracting the second volume from the first volume.

16. The method of claim 15, further comprising:

determining a first position of the plunger when the suction valve closed;

determining a second position of the plunger when the suction valve opened;

determining a change in a plunger position by subtracting the first position from the second position; and determining the actual flow rate of the fluid through the chamber based on the volume of fluid in the chamber and the change in plunger position.

17. A system, comprising:

a blender fluidly couplable to an inlet of a first manifold to deliver intervals of fluid mixtures to the first manifold at a total flow rate into the first manifold, the intervals including a first interval of a first fluid mixture having a first concentration of proppant and a second interval of a second fluid mixture having a second concentration of proppant that is different than the first concentration of proppant;

a plurality of pressure pumps fluidly couplable to the first manifold at an input of the plurality of pressure pumps to receive the intervals of the fluid mixture; and one or more computing devices configured to:

determine an actual flow rate of fluid through at least one pump of the plurality of pressure pumps by:

determining a transition of a plunger in the at least one pump during a pump stroke in a chamber of the at least one pump using a position signal generated by a position sensor among a plurality of position sensors coupled to the plurality of pressure pumps, the position signal corresponding to a position of a respective rotating member in the at least one pump;

determining actuation points of a valve in the chamber by identifying at least two discontinuities in a strain signal generated by a strain gauge subsequent to a loading or unloading of strain in the chamber, wherein the strain gauge is part of a plurality of strain gauges coupled to the plurality of pressure pumps and the strain signal corresponds to strain in the chamber of the at least one pump, and wherein the actuation points include a first actuation point corresponding to a beginning of the pump stroke and a second actuation point corresponding to an ending of the pump stroke; and determining a chamber flow rate of fluid through the valve based on the determined actuation points and the transition of the plunger; and adjust the actual flow rate of the fluid through the at least one pump such that a timing pattern of the intervals of the fluid mixtures out of a second manifold at an output of the plurality of pressure pumps matches the timing pattern into the first manifold.

18. The system of claim 17, further including a wellhead positionable proximate to a wellbore, the wellhead being fluidly couplable to an outlet of the second manifold to receive the intervals of the fluid mixtures at the timing pattern and inject the intervals of the fluid mixtures into the wellbore at the timing pattern to fracture a subterranean formation adjacent to the wellbore.

19. The system of claim 17, wherein the plurality of pressure pumps are positionable in parallel between the first manifold and the second manifold, wherein the plurality of pressure pumps includes at least a first pump, a second pump, and a third pump, wherein the first pump is positionable farther from the inlet of an intake manifold and an outlet of an output manifold than the second pump, wherein the second pump is positionable farther from the inlet and the outlet than the third pump.

20. The system of claim 17, wherein the one or more computing devices are further configured to determine the actual flow rate of the fluid by:

determining a first volume of fluid flowing from the chamber to an output manifold between an opening of a discharge valve and a closing of the discharge valve;

determining a second volume of fluid flowing back from the output manifold into the chamber to close the discharge valve; and determining a volume of fluid in the chamber by subtracting the second volume from the first volume.

* * * * *